US011313132B2

(12) United States Patent
Coyle

(10) Patent No.: US 11,313,132 B2
(45) Date of Patent: Apr. 26, 2022

(54) COVERING ELEMENT SUPPORT ARRANGEMENT

(71) Applicant: Masonry Support Systems Limited, Swadlincote (GB)

(72) Inventor: Sean Coyle, Swadlincote (GB)

(73) Assignee: Masonry Support Systems Limited, Swadlincote (GB)

( * ) Notice: Subject to any disclaimer, the term of this patent is extended or adjusted under 35 U.S.C. 154(b) by 0 days.

(21) Appl. No.: 16/943,267

(22) Filed: Jul. 30, 2020

(65) Prior Publication Data

US 2021/0032873 A1 Feb. 4, 2021

(30) Foreign Application Priority Data

Jul. 30, 2019 (GB) ..... 1910870
Sep. 10, 2019 (GB) ..... 1913072

(51) Int. Cl.
*E04F 13/08* (2006.01)
*E04F 13/14* (2006.01)
(Continued)

(52) U.S. Cl.
CPC ..... *E04F 13/0833* (2013.01); *E04B 1/40* (2013.01); *E04F 13/0801* (2013.01);
(Continued)

(58) Field of Classification Search
CPC . E04F 13/0833; E04F 13/147; E04F 13/0862; E04F 13/0805; E04F 13/0825;
(Continued)

(56) References Cited

U.S. PATENT DOCUMENTS 1,655,117 A * 1/1928 Voight ..... E04F 13/045 52/682
1,675,201 A * 6/1928 Voight ..... E04F 13/045 52/682
(Continued)

FOREIGN PATENT DOCUMENTS

CA 2526876 2/2006
CA 3007164 A1 * 12/2019 ..... E06B 1/62
(Continued)

OTHER PUBLICATIONS

European Search Report dated Dec. 8, 2020.

*Primary Examiner* — Brent W Herring
(74) *Attorney, Agent, or Firm* — Preston Smirman; Smirman IP Law, PLLC

(57) ABSTRACT

A covering element support arrangement for attaching covering elements to a building or building component. The covering element support arrangement has a carrier means for receiving covering elements thereon. The covering element support arrangement further has an attachment means for attaching covering elements to the carrier means. The attachment means involves mechanical fastening means that can be fastened to the carrier means and that are engageable with covering elements to fix the covering elements to the carrier means. The carrier means is formed at least partially from a perforated sheet and the mechanical fastening means is engageable with the perforations. The frequency of the perforations is such that a covering element can be attached to the carrier means without requiring the covering element to be initially aligned relative to any single perforation. This thereby reduces the time required to fit covering elements.

20 Claims, 15 Drawing Sheets

(51) Int. Cl.
*E04B 1/41* (2006.01)
*E04B 1/38* (2006.01)

(52) U.S. Cl.
CPC ..... *E04F 13/0825* (2013.01); *E04F 13/0846* (2013.01); *E04F 13/0862* (2013.01); *E04F 13/14* (2013.01); *E04F 13/147* (2013.01); *E04B 2001/405* (2013.01)

(58) Field of Classification Search
CPC ..... E04F 13/14; E04F 13/0801; E04F 13/22; E04F 13/0846; E04B 1/40; E04B 2001/405; E04B 1/4178; E04B 2002/565; E04C 2003/023; E04C 2002/007
USPC ..... 52/506.05, 235, 206.08, 506.09, 507
See application file for complete search history.

(56) References Cited

U.S. PATENT DOCUMENTS 1,856,205 A * 5/1932 Boyle ..... E04F 13/045 52/714
1,993,432 A * 3/1935 Boyle ..... E04F 13/045 52/684
3,412,512 A * 11/1968 Hollister ..... E04F 13/047 52/239
4,506,482 A * 3/1985 Pracht ..... E04B 2/88 52/235
4,642,960 A * 2/1987 Wallover, III ..... E04B 2/8605 52/385
5,697,195 A * 12/1997 Maylon ..... B32B 3/12 52/344
8,782,988 B2 * 7/2014 Wolf ..... B29C 39/18 52/539
2011/0047914 A1 * 3/2011 Sarrablo Moreno ... E04B 1/166 52/388
2016/0153198 A1 * 6/2016 Hatzinikolas ..... E04F 13/0805 52/702
2016/0305113 A1 * 10/2016 Hatzinikolas ..... E04F 13/0801
2016/0312461 A1 * 10/2016 Naylor ..... E04F 13/12
2018/0283012 A1 * 10/2018 Hohmann, Jr. ..... E04F 13/081
2020/0378132 A1 * 12/2020 Hatzinikolas ..... E04F 13/0805

FOREIGN PATENT DOCUMENTS

EP 3330449 6/2018
EP 3330449 A1 * 6/2018 ..... E04F 13/0733
GB 2345924 A * 7/2000 ..... E04F 13/14
GB 2363404 A * 12/2001 ..... E04G 21/1841
GB 2562867 11/2018
KR 20110000315 A * 1/2011
WO WO-2017017563 A1 * 2/2017 ..... E04B 1/2604

* cited by examiner

COVERING ELEMENT SUPPORT ARRANGEMENT

CROSS-REFERENCE TO RELATED APPLICATION

The instant application claims priority to United Kingdom Patent Application Serial No. GB1910870.3 filed Jul. 30, 2019, pending, and United Kingdom Patent Application Serial No. GB1913072.3 filed Sep. 10, 2019, pending, the entire specifications of which are expressly incorporated herein by reference.

FIELD OF THE INVENTION

The present invention relates to a covering element support arrangement for allowing covering elements to be securely attached to a building or building component.

BACKGROUND OF THE INVENTION

In construction, there has been an increasing trend towards the use of masonry slips, such as brick slips, which are often bonded to carriers, and then mounted on a face of a building. Such arrangements can be used, for example, in cladding panels or lintels to form parts of the fascia or soffit of a building. Masonry slip arrangements can be prefabricated before transporting to a site for installation and this reduces the amount of onsite time required to construct a building. Additionally, masonry slips arranged as ornate features, such as arched lintels, replaces onsite crafting, which can often be time consuming and require a high level of skill. Construction companies can produce entire building facades and sidings, composed of a plurality of masonry slip units, within a factory in a quality-controlled setting before transporting and assembling on site.

Concerns are being raised by certain sectors that the connection between the masonry slips and the carrier will weaken over time and the slips may come loose and fall from height. This is particularly concerning when the masonry slips form a part of a soffit and are therefore located vertically beneath the carrier, as gravity is constantly pulling the masonry slips away from the backing board. To mitigate this risk, there have been some recent improvements in how slips are bonded to carriers. In some arrangements, slips are bonded to a carrier using epoxy resins or mortar. However, recent research has suggested that certain resins that are used for bonding slips to carriers emit harmful toxins when burnt; such toxins can result in fatalities for occupants of a building in the event of a fire. This is of particular concern in tall (over 18 metres) residential buildings, and in the UK there are specific regulations to control the use of such resins in component parts of tall buildings. It is expected that these regulations will be developed to further restrict usage of resins. There is therefore a need to reduce or replace the use of certain epoxy resins in these building components.

One way to reduce the over-reliance on epoxies and mortar when attaching slips to carriers is to use additional mechanical fixings such as bolts or screws to retain the slips on the carrier. Where a carrier formed from one or more steel sheets is used, it is required to initially measure the location of holes and then drill the carrier with holes to receive mechanical fixes. The slips must then be aligned with the holes before being fixed to the carrier. This process is time consuming as there is minimal allowance for error. If the slip is not correctly aligned with the predrilled hole, then another hole must be drilled before a mechanical fix can be applied.

Some prior art brackets used in fixing adjacent slips to a carrier are sized and shaped such that they fill the space between the adjacent slips. These brackets can be slid along the gap between the slips but they cannot be maneuvered in any other direction. If the hole in the carrier that is used to fix the bracket to the carrier is not located in the centre between two slips, then the bracket will simply not fit into place and cannot be maneuvered into position. This can lead to further requirements for realignment of the slips on the carrier and/or drilling of new holes.

SUMMARY OF THE INVENTION

It is an object of the present invention to obviate or mitigate the problems outlined above. In particular, it is an object of the invention to reduce reliance on epoxies and mortars when attaching covering elements such as masonry slips to carriers.

It is a further object of the invention to provide a more versatile covering element support means for fixing masonry slips thereto.

It is a yet further object of the invention to provide a quicker, easier and more effective way to attach masonry slips to carriers.

According to a first aspect of the invention there is provided a covering element support arrangement for attaching covering elements to a building or building component, the covering element support arrangement comprising a carrier means for receiving covering elements thereon, the covering element support arrangement comprising attachment means for attaching covering elements to the carrier means, the attachment means comprising mechanical fastening means that can be fastened to the carrier means and that are engageable with covering elements to fix the covering elements to the carrier means, the carrier means being formed at least partially from a perforated sheet, the mechanical fastening means being engageable with the perforations, and wherein the frequency of the perforations is such that a covering element can be attached to the carrier means without requiring the covering element to be initially aligned relative to any single perforation.

Advantageously, the use of mechanical fastening means allows covering elements, such as masonry slips, to be more readily mechanically fixed to a carrier means and this discourages the use of copious amounts of epoxy resin. The reliance on adhesives, such as certain epoxy resins, which can emit toxic fumes when burnt, is thereby mitigated by use of a carrier means to which covering elements can be easily mechanically fixed.

Ideally, the mechanical fastening means comprises a bracket for fixing two adjacent covering elements to a carrier means.

Ideally, each perforation provides an attachment means receiving means.

Preferably, the bracket is configured such that it is maneuverable laterally between adjacent covering elements when located in the gap between covering elements and/or is rotatable about its axis when located between two adjacent covering elements such that it can be maneuvered to align with an attachment means receiving means on the carrier means to enable fixing thereto.

Advantageously again, the manufacturer can manoeuvre the bracket in multiple directions relative to the covering elements to align the bracket with an attachment means receiving means of the carrier means. In prior art systems the bracket can only be moved longitudinally in the gap between covering elements by sliding it along the groove in the sides of the covering elements. Maneuverability is thereby dependent on the length of the groove extending along the edge of the covering elements. By configuring the bracket such that it can be moved laterally or rotated relative to the covering element, the length of the groove in the covering element can be reduced because maneuverability of the bracket is no longer dependent wholly on the length of the groove. The covering elements are thereby quicker and easier to produce. The enhanced maneuverability of the bracket further removes the requirement for careful alignment of the attachment means receiving means relative to the covering means and so this saves time and effort in fixing covering elements to the carrier means.

Preferably the perforations can receive an adhesive, mechanical fixing, or both. This allows the carrier to be more adaptable and enables a variety of covering means configurations to be mounted on the carrier means.

Preferably the carrier means comprises a regular arrangement of apertures, perforations or holes. The terms 'apertures', 'perforations' and 'holes' as used herein in relation to the carrier means may be used interchangeably.

Preferably the carrier means comprises a regular arrangement of apertures, perforations, or holes over at least a part of one face of the carrier means.

Preferably the carrier means comprises a regular arrangement of perforations over substantially all of one face of the carrier means.

Preferably the carrier means comprises a regular arrangement of perforations over substantially all of the carrier means.

Preferably the carrier means comprises at least a portion having no perforations.

Preferably the perforations are arranged in a honeycomb pattern.

Ideally the carrier means comprise a high frequency of apertures, perforations or holes.

Ideally the frequency of apertures, perforations or holes in combination with the maneuverability of the bracket, is such that regardless of the location of the placement of the covering element on the covering means, at least one aperture, perforation or hole will be suitable for use in fixing the covering element to the covering means.

Advantageously, using a high frequency of perforations reduces the weight of the carrier means and ensures that at least one perforation will be located between neighbouring covering elements when the covering elements are placed on the carrier means. Advantageously again, the manufacturer can place the covering elements on the covering means in any desired pattern. Yet further advantageously, as a regular pattern of perforations is used it is easy to automate the process of perforating the carrier and this removes the requirement for manually drilling perforations in the carrier means.

Ideally over 10% of the area of the carrier means is open/perforated.

Ideally over 20% of the area of the carrier means is open/perforated.

Ideally over 30% of the area of the carrier means is open/perforated.

Ideally over 40% of the area of the carrier means is open/perforated.

Ideally over 50% of the area of the carrier means is open/perforated.

Ideally the radius of each perforation is between about 2 and 5 mm.

Preferably the radius of each perforation is about 3 mm.

Preferably the pitch/distance between the centre of neighbouring holes is between about 1 and 10 mm.

Preferably the pitch/distance between the centre of neighbouring holes is about 5 mm.

Preferably the apertures are generally circular or rectangular.

Preferably the apertures, perforations or holes are sized to receive fixing means.

Preferably the fixing means are screws or bolts.

Preferably the apertures, perforations or holes are sized to allow adhesive material to pass through the holes.

Preferably the apertures, perforations or holes in the carrier means provide predetermined positions for the mechanical fastening means.

Ideally one or more covering elements are attached to the carrier means.

Preferably the covering elements are slips such as brick, block or stone slips, or composite such as glass-reinforced plastic slips.

Ideally the or each covering element includes an interior face for attachment to the carrier means, an exterior face opposite the interior face and a plurality of peripheral edge faces connecting the interior face and the exterior face.

Preferably the mechanical fastening means is/are made from corrosion-resistant material.

Ideally the mechanical fastening means is/are formed from metal, most preferably steel, most preferably stainless steel or galvanised steel.

Preferably the or each bracket comprises a base that is fixable to the carrier means.

Ideally the bracket is fixable to the carrier means and can engage with at least one covering element to fix the covering element to the carrier means.

Most preferably the bracket can engage with two adjacent covering elements to fix the covering elements to the carrier means.

Ideally the bracket can be fixed to the carrier means and can engage with two adjacent covering elements in more than one orientation relative to the covering elements.

Advantageously, the manufacturer can re-orientate the bracket if the bracket does not align with a perforation on the carrier means.

Ideally the bracket can be fixed to the carrier means and be in engagement with two adjacent covering elements in more than one axial orientation relative to the covering elements.

Ideally the base abuts the carrier means in use.

Preferably the base of the or each bracket is planar.

Preferably the base of the or each bracket comprises an aperture, hole or slot for allowing a fixing means to pass therethrough.

Ideally the base of the or each bracket comprises an elongate aperture/slot.

Advantageously the elongate aperture provides further maneuverability of the bracket relative to the covering elements when fixing the bracket to the covering means, as the axis of the aperture of the bracket does need to be exactly coaxial with the perforation, hole or aperture in the carrier means to enable fixing thereto, and some amount of misalignment is tolerable.

Ideally the bracket is configured such that it is rotatable when the bracket is located between two adjacent covering elements thereby moving the aperture, hole or slot relative to the carrier means, such that it can be maneuvered to align with an attachment means receiving means on the carrier means to enable fixing thereto.

Preferably the or each bracket comprises an engagement means for engaging with one or more covering elements.

Ideally the engagement means is a planar engagement means.

Preferably the engagement means is shaped such that it does not obscure the view of the base of the bracket in use.

Preferably the engagement means is generally U-shaped.

Ideally the engagement means is shaped to extend between a slot in a first covering element to a slot in an adjacent second covering element.

Preferably the engagement means of the or each bracket comprises a free end for engaging a slot in a first covering element, and at least one prong for engaging a slot in a second covering element. Most preferably, the first covering element and second covering element are neighbouring covering elements.

Preferably the free end is integrally connected to the or each prong.

Preferably the engagement means of the or each bracket has two prongs.

Ideally a portion of the bracket extends from the engagement means towards the carrier means in use.

Preferably the or each bracket comprises a pillar for connecting the base to the engagement means.

Preferably the or each pillar is planar.

Preferably the or each bracket comprises a single pillar for connecting the base to the engagement means.

Advantageously, using a single pillar means that the part of the second covering element may be located over the base of the bracket in use. Prior art brackets have a base and two mutually opposing pillars extending upwards from the base to two free ends that engage with the covering elements. The pillars of these brackets must be positioned abutting each covering element as the distance between the pillars defines the size of the gap between the covering elements. The bracket cannot be rotated relative to the covering elements because the two mutually opposing pillars abut the adjacent covering elements. These arrangements can make it difficult for the manufacturer to align the bracket with a perforation on the carrier means. With these prior art arrangements, the apertures in the carrier and the brackets must be precisely aligned before attaching the masonry slips to the carrier. Time must be taken to ensure that this is done correctly, and the possibility of errors cannot be ruled out. By providing a bracket with a single pillar, the bracket location can be adjusted such that the pillar is not abutting either covering element, and the gap between covering elements is not defined by the gap between the pillars of the bracket(s). The single pillar does not need to be parallel to the plane of the side of either covering element and may be even be installed extending diagonally relative to the plane of the side of the covering elements.

Preferably the length of the or each pillar corresponds to the distance between the interior face and the slot of the covering element.

Preferably the length of the or each pillar corresponds to the distance between the interior face and the slot of the covering element and the thickness of adhesive used to fix the covering element to the carrier means.

Ideally the length of the or each pillar is shorter than the total distance between the interior face and the slot of the covering element and the thickness of adhesive used to fix the covering element to the carrier means. Advantageously, this means that when the bracket is fixed to the carrier means it compresses the covering element towards the carrier means.

Preferably the length of the or each pillar is between about 5 mm to 25 mm.

Preferably the length of the or each pillar is between about 10 mm to 15 mm.

Preferably the or each bracket is made from a sheet having a plurality of bends.

Preferably a first bend defines the joint between the base and the pillar.

Preferably a second bend defines the joint between the pillar and the engagement means.

Preferably the bracket base, engagement means and pillar are integrally formed.

Preferably the base is connected to the pillar at one end of the pillar, and the engagement means is connected to the pillar at an opposing end of the pillar.

Preferably the base extends from the pillar in a first direction.

Preferably the free end extends from the pillar in a second direction.

Ideally the first direction being a different direction to that of the second direction.

Preferably the or each prong extends from the free end in the first direction.

Preferably the or each bracket base is located between the two prongs at the opposite end of the pillar to the engagement means.

Preferably each covering element has a thickness of about 25 mm to 35 mm.

Ideally the or each covering element includes a slot in one or more of the peripheral edges of said covering element for receiving at least a portion of the attachment means.

Ideally the or each slot is located between about 10 mm to 15 mm from the interior face of the covering element.

Preferably the carrier means comprises at least one generally planar surface.

Preferably the carrier means is made from steel, most preferably stainless steel.

Preferably the carrier means is between about 1 mm to 10 mm thick.

Preferably the carrier means is about 2 mm thick.

Preferably the carrier means is formed at least partially by a flat, bent or curved metal sheet.

Ideally the carrier means includes at least one bend.

Ideally the carrier means is generally L-shaped.

Preferably the carrier means has a soffit surface.

Ideally the carrier means has an upstanding planar surface.

Ideally the carrier means has a fascia surface that forms a part of a fascia of a building when installed.

Preferably the upstanding planar surface and the fascia surface are the same surface.

Ideally the soffit surface is substantially perpendicular to the upstanding planar surface.

Ideally one or more covering elements may be attached to the soffit surface and/or the upstanding planar surface.

Ideally the carrier means is adapted to receive covering elements in a plurality of positions and/or configurations.

Preferably the covering elements are mechanically fixed and/or adhesively bonded to the carrier means.

Preferably the attachment means further comprises adhesives.

Preferably the adhesive comprises an epoxy, A1-rated non-toxic adhesive, polymer-modified adhesive and/or mortar.

Preferably the attachment means comprises at least one end clip for attaching one end of a peripheral covering element to the covering element support arrangement.

Preferably the or each end clip is made from 1 mm stainless steel sheet.

Preferably the or each end clip is generally C-shaped.

Preferably the or each end clip comprises a base.

Preferably the base of the or each end clip is planar.

Preferably the base of the or each end clip comprises an aperture, hole or slot for allowing a fixing means to pass therethrough.

Preferably the or each end clip comprises a engagement means, most preferably, a planar engagement means.

Preferably the engagement means of the or each end clip comprises a free end for engaging a slot in a peripheral covering element.

Preferably the or each end clip comprises a connection strip for connecting the base to the engagement means.

Preferably the or each connection strip is planar.

Preferably the length of the or each connection strip is about 10 mm to 50 mm.

Preferably the length of the or each connection strip is about 21 mm to 26 mm.

Preferably the or each end clip is made from a sheet, e.g. a stainless steel sheet, having a plurality of bends.

Preferably a first bend defines the joint between the base and the connection strip.

Preferably a second bend defines the joint between the connection strip and the engagement means.

Preferably the end clip base, engagement means and connection strip are integrally formed.

Preferably the base and engagement means are connected to the connection strip at opposing ends of the connection strip.

Preferably the base extends from the connection strip in the same direction as the engagement means.

Ideally the covering element support arrangement comprises a backing means located at the back of the carrier means.

Preferably the carrier means is attached to the backing means.

Ideally the backing means and the carrier means are attached together at least partially via adhesive.

Ideally the adhesive attaching the backing means to the carrier means extends through the holes/apertures/perforations of the carrier means.

Advantageously this provides a mechanical lock between the carrier means and the backing means when the adhesive hardens.

Preferably the length of the or each connection strip of the end clip corresponds to the sum of distance between the interior face and the slot of the covering element, the thickness of the backing means and the thickness of the carrier means and the depth of the adhesive present on either side of the carrier means.

Ideally the backing means is an elongate backing means.

Ideally the backing means is between about 5 mm and 20 mm thick.

Preferably the backing means is about 9 mm thick.

Ideally the backing means extends along the entire length of the covering element support arrangement.

Preferably the backing means is formed from a material that can readily receive a self-tapping screw.

Advantageously, the brackets can be fixed to the carrier means by inserting a screw through the bracket base, through a hole/aperture/perforation and into the backing means.

Ideally the backing means is formed at least partially from cementitious and/or composite material.

By "cementitious" it is meant a substance formed from bound together aggregates, such as concrete or magnesium or calcium silicate particle board. Such materials can easily receive self-tapping screws and are typically non-combustible.

Preferably the backing means is non-combustible.

Preferably the backing means is entirely formed from cementitious/composite material.

Preferably the backing means is formed at least partially from mineral particle board such as calcium silicate sheathing board, magnesium oxide particle board, concrete, fiber-reinforced polymers, FRPs (including wood comprising cellulose fibers in a lignin and hemicellulose matrix), carbon-fiber reinforced plastic (CFRP) or glass-reinforced plastic (GRP), thermoplastic composite (short fiber thermoplastics, long fiber thermoplastics or long fiber-reinforced thermoplastics), thermoset composite, and/or aramid fibre and carbon fibre in an epoxy resin matrix.

Ideally the covering element support arrangement comprises reinforcement means.

Preferably the reinforcement means includes one or more plates which are attached to the carrier means. Advantageously, the reinforcement means provide increased strength to the carrier means to prevent flex and movement of the carrier means in the installed condition.

Preferably the reinforcement means comprises one or more gussets.

Preferably the or each gusset has a thickness of 2.5 mm.

Preferably the or each gusset includes a slot to receive a backing means.

Preferably the or each gusset is attached to the carrier means on either side of the slot.

Ideally the covering element support arrangement comprises a connection means for connecting the covering element support arrangement to a building or building component.

Preferably the gussets include slots or gaps to receive the connection means.

Preferably the connection means is attached to the reinforcement means.

Advantageously, using spaced apart reinforcement means instead of a continuous support structure can reduce the overall mass of the covering element support arrangement.

Ideally, the connection means is operable to attach or mechanically fix the covering element support arrangement to a building or building component, or to hang the covering element support arrangement from a building or building component.

Preferably, the connection means is operable to retain the covering element support arrangement at or about a face of a building.

Preferably the connection means is operable to attach or mechanically fix the covering element support arrangement on a building such that at least part of the covering element support arrangement forms at least a part of a building soffit.

Ideally the connection means is an elongate connection means.

Ideally the connection means is operable to receive fixing means.

Preferably the connection means comprises a channel.

Preferably the channel is a 41 mm by 21 mm steel channel.

Preferably the connection means comprises a channel that is operable to receive fixing means such as a nut and bolt.

Preferably the connection means comprises a steel channel.

Preferably the connection means comprises a mechanical fixing such as screws or bolts.

Ideally, the fixing means is/are movable relative to the channel. Advantageously, as the fixing means are movable relative to the channel, the position of the covering element support arrangement can be adjusted before fixing the covering element support arrangement to a mount.

In one embodiment, the fixing means is a male fixing means such as a bolt or screw that protrudes from the channel to engage with a female fixing means such as a nut.

Alternatively the fixing means is a female fixing means such as a nut that can receive a male fixing means that extends to the female fixing means of the connection means.

Preferably the female fixing means is a nut or machined block having an aperture to receive and fixedly engage with a male fixing means such as a bolt.

Ideally the fixing means is a spring nut.

Preferably the connection means comprises a retaining means to retain at least one fixing element within the channel.

Ideally the channel is shaped to movably retain the fixing means within the channel.

Preferably the retaining means comprises a retaining lip that extends over an opening in the channel to movably retain the fixing means therein.

Ideally wherein the fixing means is a spring nut, the spring biases the nut against the retaining means.

Advantageously the location of the covering element support arrangement relative to the building component to which it is fixable can be adjusted along the longitudinal axis of the elongate channel before torquing the fixings.

Optionally the connection means is directly connectable to a building or building component.

Alternatively the attachment means comprises an interlocking arrangement to enable the attachment means to interlock with a corresponding arrangement on a building component.

Ideally the connection means is connectable to a mounting means.

Preferably the mounting means is adapted to be mechanically fixed to a building or building component.

Ideally the mounting means is adapted to receive and retain the covering element support arrangement.

Ideally the mounting means is adapted to engage with the connection means to mechanically fix, interlock or hang the covering element support arrangement therefrom.

Preferably the mounting means is adapted to form at least a part of a lintel or soffit support structure.

Preferably the mounting means comprises fixings, and/or is adapted to receive fixings, the fixings being operably engageable with the attachment means to retain the covering element support arrangement on the mount.

Preferably the engagement between the mounting means and the connection means is adjustable. Advantageously, this provides further adjustability of the location of the covering element support arrangement on the building facing even after the mount has been mounted on a surface such as an inner leaf of a cavity wall.

Ideally the mounting means is mountable on a surface such as an inner leaf of a cavity wall. Advantageously, the adjustable mounting means allow the position of the mount relative to the surface to which it is fixed to be adjusted after installation. This allows fine adjustment of the position of the building component and this correspondingly allows fine adjustment of the location of the covering element support arrangement on the face/soffit of the building.

Preferably the mounting means comprises one or more mounting brackets operable to be mounted to a surface such as an inner leaf of a cavity wall.

Ideally the mounting means includes a masonry support surface.

Ideally the masonry support surface is engaged with and is supported by the one or more mounting brackets.

Ideally the one or more mounting brackets comprise a slot to receive a bracket fixing means.

Preferably the mounting means comprises a lock washer that can be locked relative to the slot in more than one configuration. Advantageously, changing the configuration of the lock washer relative to the slot can adjust the location of the bracket relative to the surface to which the bracket is fixed via a bracket fixing means that extends through the slot and into the surface.

Ideally the lock washer comprises a body; a protrusion disposed on one face of the body, the protrusion being configured to be disposable in a corresponding slot of a bracket; an engagement means disposed on the protrusion, the engagement means being configured to be engageable with the slot of the bracket and to hold the body stationary with respect to the bracket; and a slotted hole disposed in the body, the slotted hole being configured to admit a shaft of a bracket fixing means therethrough so as to allow lateral movement of the body relative to the shaft while the shaft is admitted through the slotted hole.

Ideally the mounting means comprises a spacer insertable between the bracket and a mounting surface in use.

Preferably the spacer is a shim.

Advantageously, this provides yet further adjustability by altering the position of the bracket, and therefore the masonry support surface, relative to the surface to which the mount is fixed.

Preferably the covering element support arrangement comprises interlocking means for interlocking with neighbouring covering element support arrangement.

Preferably the interlocking means comprises a female interlocking formation for interlocking with an appropriately-configured male interlocking formation.

According to a second aspect of the invention there is provided a covering element support arrangement for attaching covering elements to a building or building component, the covering element support arrangement comprising a carrier means for receiving covering elements thereon, the covering element support arrangement comprising attachment means for attaching covering elements to the carrier means, the attachment means comprising mechanical fastening means that can be fastened to the carrier means and that are engageable with covering elements to fix the covering elements to the carrier means, the mechanical fastening means comprising a bracket for fixing two adjacent covering elements to a carrier means, the carrier means comprising a plurality of attachment means receiving means for receiving the mechanical fastening means to fix the mechanical fastening means to the carrier means, wherein the bracket is configured such that it is maneuverable laterally between adjacent covering elements when located in the gap between covering elements and/or is rotatable about its axis when located between two adjacent covering elements such that it can be maneuvered to align with an attachment means receiving means on the carrier means to enable fixing thereto.

Ideally the or each attachment means receiving means is a hole, aperture or perforation.

According to a third aspect of the invention there is provided a bracket for fixing two adjacent covering elements to a carrier means, the bracket comprising a base that is fixable to the carrier means, and an engagement means for engaging with and fixing covering elements to a carrier means, the engagement means being shaped to extend between a first covering element and an adjacent second covering element, the bracket further comprising a pillar that extends between the base and the engagement means thereby connecting the base to the engagement means.

Ideally the bracket comprises a single engagement means that engages with both adjacent covering elements.

Preferably the bracket comprises a single pillar.

According to a fourth aspect of the invention there is provided a covering element support arrangement for attaching covering elements to a building or building component, the covering element support arrangement comprising a carrier means for receiving covering elements thereon in a plurality of positions and/or configurations.

Advantageously, allowing the covering elements to be received on the carrier means in a plurality of positions provides an adaptable covering element support arrangement which can receive covering elements of any suitable size and shape.

Preferably the covering element support arrangement comprises an attachment means for attaching the covering elements to the carrier means.

Ideally the attachment means comprises a mechanical fastening means.

Ideally the mechanical fastening means comprises a bracket and/or clip.

Ideally the bracket can be moved laterally between two adjacent covering elements within the gap between the covering elements and can be fixed to the carrier means and be in engagement with the covering elements in more than location between the covering elements.

Ideally the bracket can be at least partially rotated about its axis when it is located within the gap between two adjacent covering elements and can be fixed to the carrier means and be in engagement with the covering elements in more than one axial orientation relative to the covering elements.

According to a fifth aspect of the invention there is provided a covering element support arrangement for attaching covering elements to a building or building component, the covering element support arrangement comprising a carrier means for receiving covering elements thereon, the covering element support arrangement comprising attachment means for attaching covering elements to the carrier means, the attachment means comprising mechanical fastening means that can be fastened to the carrier means and are engageable with covering elements to fix the covering elements to the carrier means, the carrier means comprising a plurality of attachment means receiving means for receiving the mechanical fastening means to fix the mechanical fastening means to the carrier means, wherein the carrier means and the mechanical fastening means are configured such that the mechanical fastening means can engage with an attachment means receiving means and a covering element to fix the covering element to the carrier means regardless of the location or orientation of the covering element on the carrier means.

Advantageously, the covering elements can be applied to the carrier means without requiring any further modification of the carrier means, and some misalignment of the brick slips is tolerated. Furthermore, any desired shape of covering element can be applied to the carrier means and any desired pattern of covering elements can be created.

According to a sixth aspect of the invention there is provided a method of constructing a support arrangement for covering elements attachable to a building or building component, the method comprising providing a carrier means for receiving at least one covering element and adapting the carrier means to allow covering elements to be received by the carrier means in a plurality of positions and/or configurations. Advantageously, allowing the covering elements to be received on the carrier means in a plurality of positions provides a more adaptable covering element support arrangement which can receive covering elements of different sizes.

Ideally the method comprises cutting covering elements, e.g. masonry or brick slips, to the required size.

Preferably the method comprises forming a groove in one or more of the peripheral edges of the covering element.

Ideally the groove is located 10-15 mm from the interior face of the covering element.

Ideally the method comprises cutting the carrier means to an appropriate size for forming at least part of a soffit of a building or for attachment to a building or building component.

Ideally the method comprises cutting the carrier means to an appropriate size for receiving one or more covering elements.

Ideally the method comprises bending the carrier means such that the carrier means is generally L-shaped and comprises a lower face which is perpendicular to an upstanding face.

Ideally the method comprises the step of forming a plurality of apertures, perforations or holes in the carrier means.

Ideally the method comprises the step of forming a regular arrangement of apertures, perforations or holes in the carrier means.

Ideally the method comprises the step of forming a rectangular arrangement of apertures, perforations or holes in the carrier means.

Ideally the method comprises the step of forming a hexagonal arrangement of apertures, perforations or holes in the carrier means.

Ideally the method comprises the step of forming apertures, perforations or holes in the carrier means by drilling or punching holes in the carrier means.

Preferably the method comprises reinforcing the carrier means.

Preferably the method comprises attaching reinforcement means to the carrier means by welding.

Preferably the method comprises reinforcing the carrier means by attaching gussets to the carrier means.

Ideally the method comprises providing a connection means for the covering element support arrangement, most preferably the connection means being in the form of a steel channel.

Preferably the method comprises attaching the connection means directly to the carrier means or indirectly, for example, via the reinforcement means, to the carrier means.

Preferably the method comprises welding the connection means to the reinforcement means.

Ideally the method comprises providing one or more slots in the reinforcement means for receiving a backing means such as a cementitious board.

Ideally the method comprises inserting a backing means between the carrier means and the reinforcement means.

Preferably the method comprises applying an adhesive layer to the carrier means.

Preferably the adhesive layer applied to the carrier means has a thickness of 3 mm.

Preferably the method comprises applying an adhesive layer to one or more covering elements.

Preferably the adhesive layer applied to the or each covering elements has a thickness of 1 mm.

Ideally the method comprises pressing the first covering element onto the carrier means after adhesive layers have been applied to the covering element and/or carrier means.

Advantageously, when a covering element is pressed onto the carrier means after adhesive has been applied, some adhesive is pushed through the perforations in the carrier means. Pushing adhesive through a perforation in a location where the backing means is positioned directly behind the carrier means causes the adhesive to push against the backing means and spread out and join so that the carrier becomes fully encased by the adhesive, and between the covering element and the backing board in a reinforced sandwich format.

Preferably the method comprises inserting mechanical fastening means into a groove on the peripheral edge of the covering element.

Preferably the method comprises retaining covering elements on the carrier means using brackets placed at the edges of the covering element.

Ideally the method comprises inserting a fixing means into an aperture, hole or slot formed in the mechanical fastening means.

Ideally the method comprises attaching the mechanical fastening means to the carrier means using a fixing means.

Ideally the fixing means is a stainless steel screw.

Ideally the mechanical fastening means is attached to the carrier means using a fixing means which passes through a hole or slot in the base of the mechanical fastening means.

Preferably the mechanical fastening means is attached to the carrier by inserting the fixing means in an aperture or perforation in the carrier means.

Ideally the mechanical fastening means is attached to the carrier by inserting the fixing means in the closest aperture or perforation in the carrier means. Advantageously, by having a plurality of apertures/perforations in the carrier means, the fixing means can be inserted into the pre-formed aperture that is in the most suitable position for holding the mechanical fastening means in its required position.

Preferably a locating member is at least partially inserted into the aperture or perforation in the carrier means prior to the curing of the adhesive.

Ideally the locating member is a pin and is most preferably formed from stainless steel.

Ideally the method includes leaving the adhesive to cure for 24 hours.

Preferably the locating member is removed after the adhesive is cured.

Advantageously this leaves clear access to the aperture or perforation in the carrier means.

Preferably the mechanical fastening means is inserted into the aperture or perforation in the carrier means, most preferably, after curing of the adhesive.

Preferably the mechanical fastening means is screwed into the aperture or perforation in the carrier means after curing of the adhesive.

Preferably the method includes inserting the or each fixing means into the carrier means such that said fixing means are partially embedded in the backing means.

Ideally the method comprises attaching a plurality of covering elements to the carrier means.

Ideally the method comprises attaching a plurality of covering elements to the carrier means using adhesive and/or mechanical fastening means.

Ideally the method comprises attaching a plurality of covering elements to the carrier means in a regular arrangement.

Ideally the method comprises retaining peripheral covering elements using end clips.

Preferably the method comprises inserting the engagement means of an end clip into a slot in the exposed edge of a peripheral covering element.

Ideally the method comprises attaching the base of the end clip to the backing means via a fixing means such as a screw or bolt.

Preferably the method includes arranging the end clip such that the backing means lies between the base of the end clip and the carrier means.

Preferably the method includes arranging the end clip such that the connection strip is proximal to an edge face of the backing means.

Ideally the method comprises attaching one or more covering element support arrangements to a building or building component.

Ideally the method comprises attaching a mounting means to a building.

Ideally the method comprises attaching the connection means of the covering element support arrangement to a mounting means to a building.

According to a seventh aspect of the invention there is provided a method of attaching covering elements to a covering element support arrangement, the covering element support arrangement having a carrier means for receiving covering elements, the method comprising providing covering elements and one or more brackets, the brackets being configured to engage with the covering elements and to be fixed to the carrier means to fix the covering elements to the carrier means, wherein the method comprises placing a first covering element on the carrier means and placing a bracket in engagement with the first covering element, placing a second covering element onto the covering means and in engagement with the bracket, leaving a gap between the first and second covering elements, and maneuvering the bracket laterally between the first and second covering elements and/or rotating it about its axis such that it aligns with an attachment means receiving means on the carrier means, and fixing the bracket to the carrier means via the attachment means receiving means.

Ideally the method comprises applying an adhesive to the carrier means and/or the covering elements before setting the covering elements on the carrier means.

Preferably the method comprises repeating the steps of applying subsequent covering elements and brackets to provide one or more rows of covering elements.

DETAILED DESCRIPTION OF THE INVENTION

Figure 1:
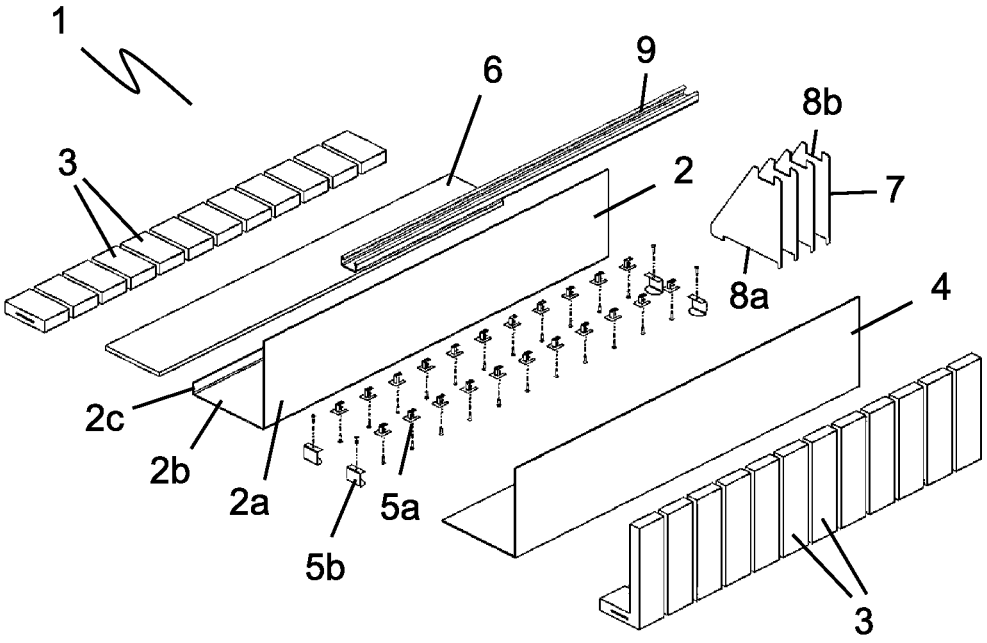
FIG. 1 is a front exploded view of a covering element support arrangement in accordance with a first embodiment of the invention.
Figure 2:
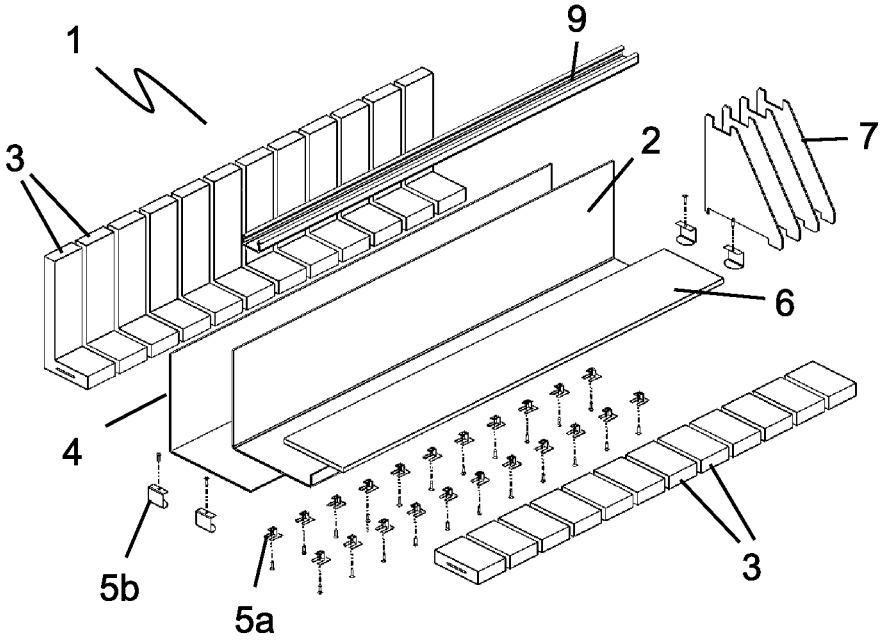
FIG. 2 is a rear exploded view of the covering element support arrangement of FIG. 1.

The skilled man will appreciate that all preferred or optional features of the invention described with reference to only some aspects or embodiments of the invention may be applied to all aspects of the invention.

It will be appreciated that optional features applicable to one aspect of the invention can be used in any combination, and in any number. Moreover, they can also be used with any of the other aspects of the invention in any combination and in any number. This includes, but is not limited to, the dependent claims from any claim being used as dependent claims for any other claim in the claims of this application.

The invention will now be described with reference to the accompanying drawings which show three embodiments of a support arrangement according to the invention by way of example only.

In FIGS. 1 to 9 there is shown a first embodiment of a covering element support arrangement according to the invention illustrated generally by reference numeral 1. The covering element support arrangement 1 comprises a carrier 2 for receiving covering elements 3 thereon in a plurality of positions and/or configurations. In this embodiment, the carrier 2 is formed from stainless steel, but other materials may also be used. In the embodiment of FIGS. 1-9 the covering elements are masonry slips 3 such as brick, block or stone slips, or glass-reinforced plastic slips that are attached to the carrier 2.

Each covering element 3 includes an interior face for attachment to the carrier means, an exterior face opposite the interior face and a plurality of peripheral edge faces connecting the interior face and the exterior face. In preferred embodiments each covering element 3 has a thickness of 25-35 mm and includes slots in two opposing peripheral edges. Each slot is located 10-15 mm from the interior face of the covering element and provides a means by which covering elements 3 may be mechanically fixed to the carrier 2. In one embodiment, the slot is provided by removing a semi-circular shaped portion of the covering element 3.

Covering elements 3 are mechanically fixed and adhesively bonded to the carrier 2. The covering elements 3 are adhesively bonded to the carrier 2 using any suitable adhesive 4 such as an epoxy resin, polymer-modified adhesive or mortar which is applied to the carrier 2 and the interior face of each covering element. However, as a mechanical fix mechanism is provided, it would be possible to forgo the adhesive. The covering elements 3 are mechanically fixed to the carrier using attachment members 5*a* and 5*b*, wherein at least a portion of each attachment member 5*a*, 5*b* is received in a slot in the peripheral edge of a covering element 3. The use of mechanical fastenings means that covering elements, such as masonry slips, can more readily be mechanically fixed to a carrier means and this discourages the use of copious amounts of epoxy resin, polymer-modified adhesive or mortar. The reliance on adhesives, such as certain epoxy resins, which can emit toxic fumes when burnt, is thereby mitigated by use of a carrier means to which covering elements can be easily mechanically fixed.

Figure 3:
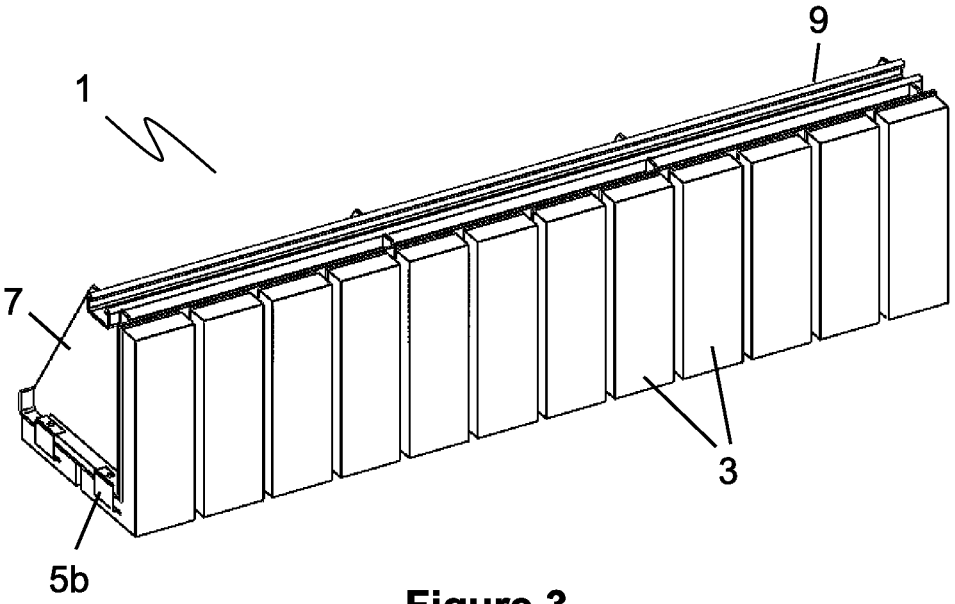
FIG. 3 is a front perspective view of the covering element support arrangement of FIG. 1.
Figure 4:
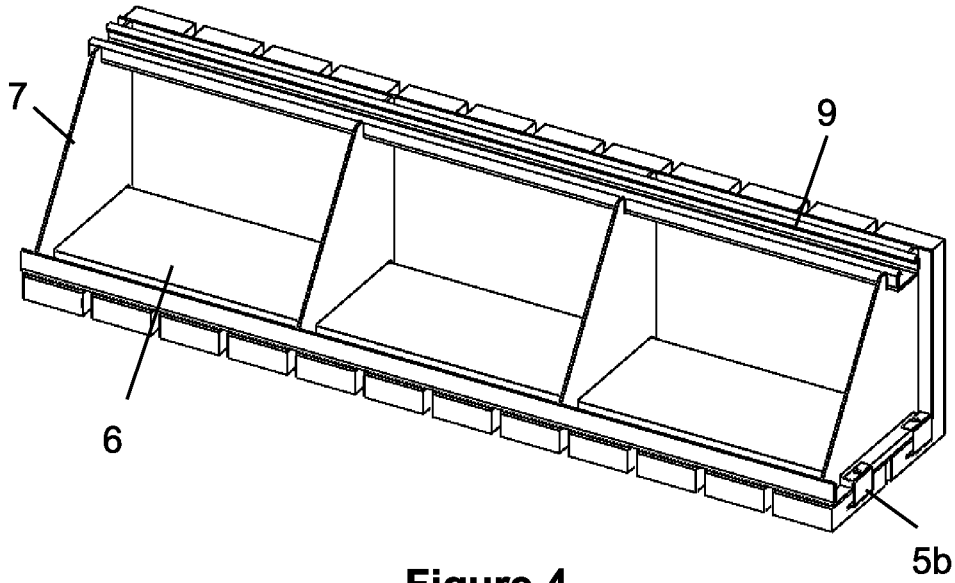
FIG. 4 is a rear perspective view of the covering element support arrangement of FIG. 1.
Figure 5:
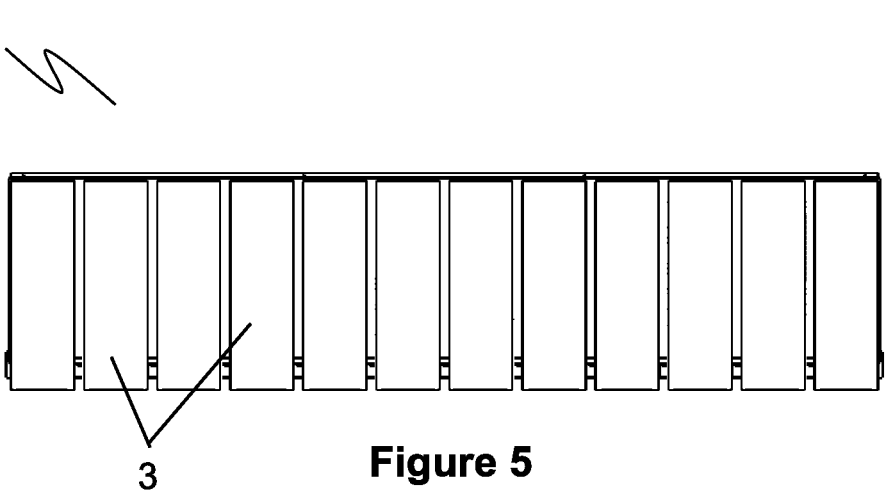
FIG. 5 is a front view of the covering element support arrangement of FIG. 1.
Figure 6:
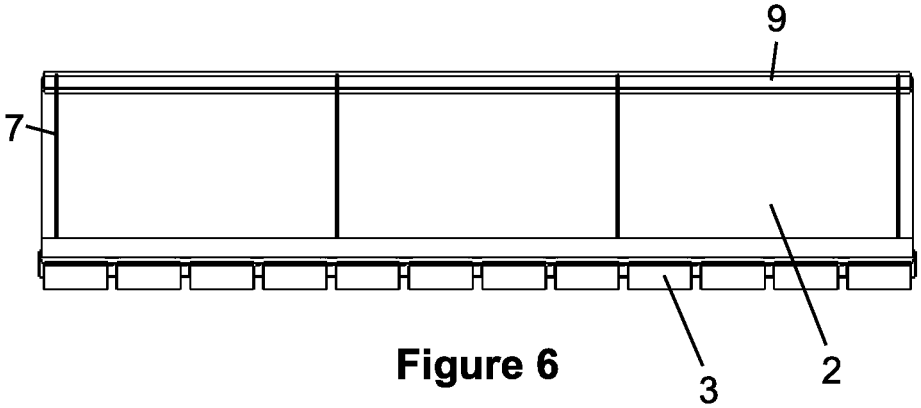
FIG. 6 is a rear view of the covering element support arrangement of FIG. 1.
Figure 7:
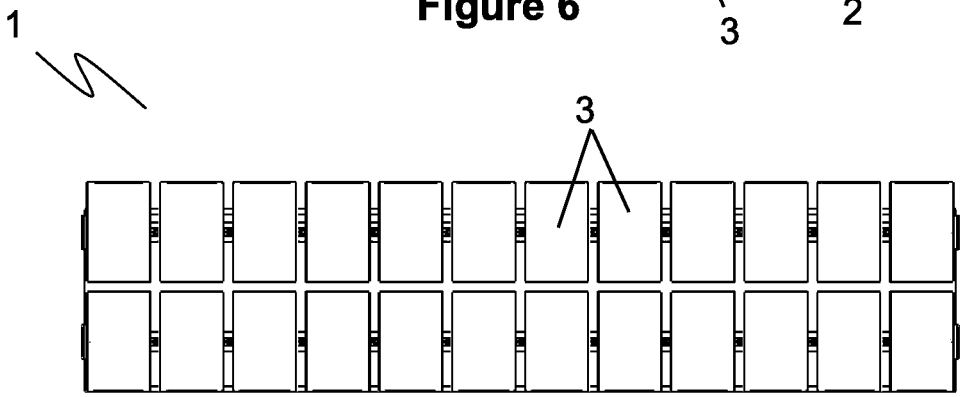
FIG. 7 is an underside/soffit view of the covering element support arrangement of FIG. 1.
Figure 8:
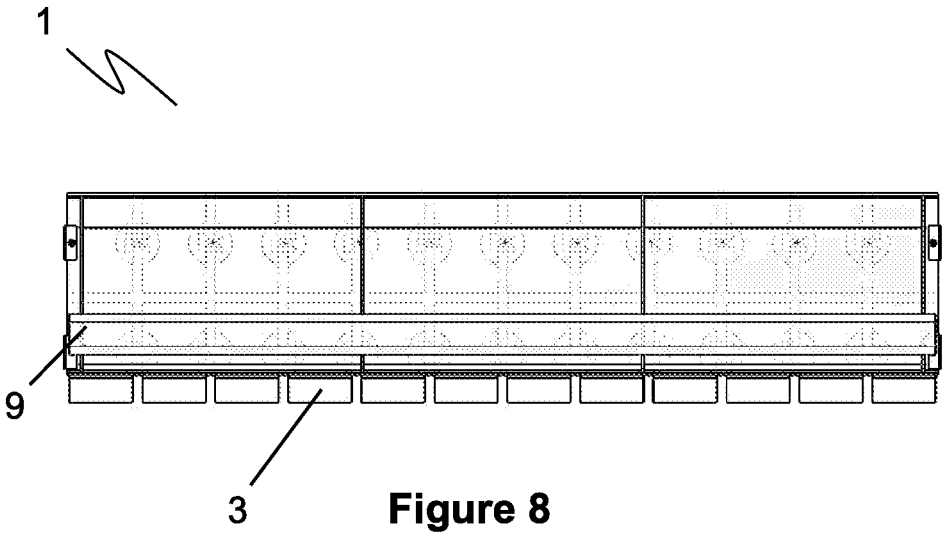
FIG. 8 is a top view of the covering element support arrangement of FIG. 1.

The carrier 2 has a generally L-shaped cross-section, having two generally planar surfaces 2*a* and 2*b* for receiving covering elements 3. The carrier 2 also includes a reinforcing flange 2*c* for the purpose of improving the rigidity of the carrier 2. The carrier 2 is constructed from a single 2 mm-thick stainless steel sheet and is bent into the configuration shown in e.g. FIG. 1. The carrier 2 comprises a soffit surface 2*b* which is perpendicular to an upstanding planar surface 2*a* and, as shown in FIGS. 3 and 4, covering elements 3 are attached to these two surfaces. L-shaped covering elements 3 are attached to both the soffit surface 2*b* and upstanding planar surface 2*a* and flat covering elements 3 are attached to the soffit surface 2*b* only.

The covering element support arrangement 1 includes an elongate backing member 6 which extends along substantially the entire length of the covering element support arrangement 1 (see FIG. 1). In this embodiment, the backing member 6 is 9 mm thick and is formed from cementitious material. By "cementitious" it is meant a substance formed from bound together aggregates, such as concrete or magnesium particle board. The backing member 6 is non-combustible and is formed from mineral particle board such as, in preferred embodiments, calcium silicate sheathing board, magnesium oxide particle board, concrete, fiber-reinforced polymers, FRPs (including wood comprising cellulose fibers in a lignin and hemicellulose matrix), carbon-fiber reinforced plastic (CFRP) or glass-reinforced plastic (GRP), thermoplastic composite (short fiber thermoplastics, long fiber thermoplastics or long fiber-reinforced thermoplastics), thermoset composite, and/or aramid fibre and carbon fibre in an epoxy resin matrix.

The covering element support arrangement 1 is reinforced using gussets 7 which are attached to the carrier 2 via welding. Each gusset is made from stainless steel and has a thickness of 2.5 mm. The gussets 7 provide increased strength to the carrier 2 thereby preventing flex and movement of the carrier 2. Each gusset 7 includes a slot 8*a* to receive the backing member 6 (see FIG. 4). Each gusset 7 engages the soffit surface 2*b* via the portion of the gusset 7 on either side of the slot 8*a*, the rear side of upstanding planar surface 2*a*, and the reinforcing flange 2*c*. Following fitting the gussets 7 to the carrier 2, the backing member 6 is inserted through the slots 8*a* of each gusset (or, alternatively, the gussets 7 may be installed after the backing member 6). The slots 8*a* are orientated relative to the carrier 2 such that when the backing member 6 is inserted, the edge of the backing member is in parallel alignment with the edge of the soffit surface 2*b*. Each gusset includes a further slot 8*b* to receive a connection member 9. The connection member 9 being welded to each gusset 7 also. Alternatively, the connection member 9 could be attached directly to the carrier 2.

Figure 10:
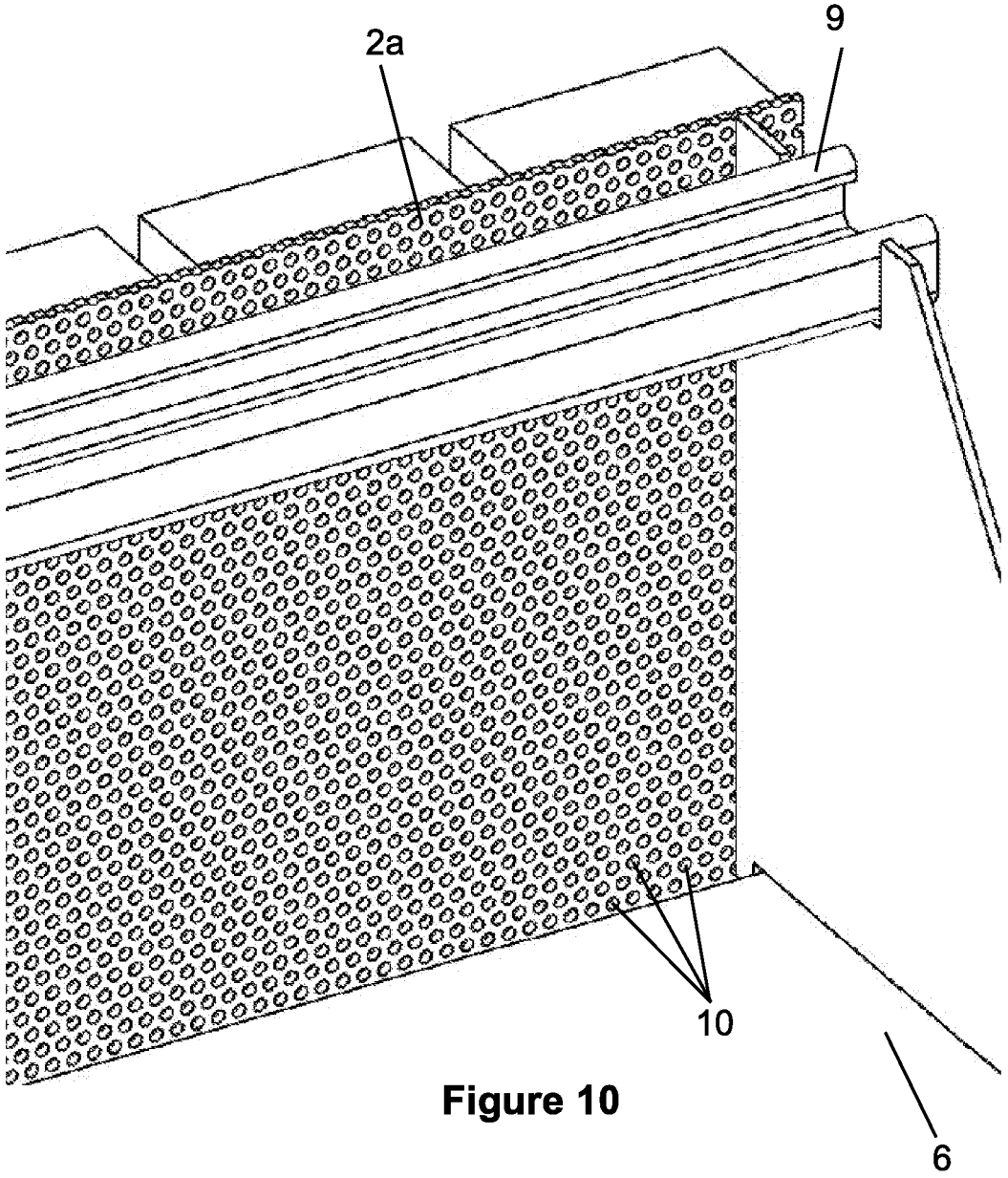
FIG. 10 is an enlarged rear perspective view of the covering element support arrangement of FIG. 1, clearly showing the pattern of perforations of the carrier.

As shown in FIG. 10, carrier 2 includes a plurality of apertures or perforations 10 for receiving both adhesive and fixing elements, the perforations being a regular arrangement of perforations on the soffit surface 2*b* and upstanding planar surface 2*a*. It should be noted that the perforations 10 are not illustrated in every drawing to enhance the clarity of the drawings where the frequency of the perforations 10 causes the drawings to be unclear. In this embodiment, the perforations are 3 mm diameter holes and are arranged in a honeycomb-like pattern and the pitch/distance between the centres of neighbouring holes is 5 mm. The skilled reader will understand that the diameter of the holes, specific pattern, and pitch/distance may altered, and a number of example of equations in the following paragraph are provided for calculating suitable patterns of perforations. The advantage of the honeycomb close-packed arrangement as shown in the detail of FIG. 10 is that this provides the highest density of perforations for a given inter-perforation-distance (i.e. the most closely packed structure of perforations 10). The perforations are sized to be able to receive and retain stainless steel screws, as well as allowing a certain amount of adhesive material to pass therethrough. This means that the perforations allow positions where mechanical fixings may be attached to the carrier 2, as well as positions where adhesive can strongly bond to the carrier 2.

In the embodiment shown, over 50% of the carrier 2 is open. The open areas of the carrier 2 can be calculated using various equations, depending on the particular pattern of perforations. If the perforations are circular, and have a triangular pitch (i.e. the rows of perforations are offset such that a perforation on an upper row is located between two perforations on the row below, thereby forming an equilateral triangle between the centre points of the perforations), then the percentage of openness can be determined by the equation:

$$\frac{R^2 \times 90.69}{T^2} = \%$$

where R is the diameter of the perforations and where T is distance between the centres of the circles forming the equilateral triangle. If the perforations are circular and are aligned such that the perforations in an upper row are in the same position as the perforations in the row below, then the percentage of openness can be determined by the equation:

$$\frac{R^2 \times 78.5}{U_1 \times U_2} = \%$$

where R is the diameter of the perforations, $U_1$ is the distance between the centre of a perforation on one row and the centre of the perforation directly below said perforation, and $U_2$ is the distance between the centre of one perforation and the centre of a perforation adjacent to said perforation on the same row. If the perforations are slotted holes with rounded edges and arranged such that a perforation on an upper row is located between two perforations on the row below, thereby forming an offset pattern, openness can be determined by the equation:

$$\frac{(R \times L - 0.215R^2) \times 100}{0.5 \times (Z_1 \times Z_2)} = \%$$

where R is the height of the perforations and L is the length of the perforations, $Z_1$ is the distance between the centre of a perforation on one row, and the centre of a perforation two rows below said perforation (i.e. the distance between aligned rows), and $Z_2$ is the distance between the centre of two perforations adjacent to one another on the same row. If the perforations are rectangular holes and arranged such that a perforation on an upper row is located between two perforations on the row below, thereby forming an offset pattern, openness can be determined by the equation:

$$\frac{100 \times L \times C}{0.5 \times (Z_1 \times Z_2)} = \%$$

where L is the length of the perforations, C is the height of the perforations, $Z_1$ is the distance between the centre of a perforation on one row, and the centre of a perforation two rows below said perforation (i.e. the distance between aligned rows), and $Z_2$ is the distance between the centre of two perforations adjacent to one another on the same row. If the perforations are square holes and arranged such that a perforation on an upper row is located between two perforations on the row below, thereby forming an offset pattern, openness can be determined by the equation:

$$\frac{C^2 \times 100}{0.5 \times (Z_1 \times Z_2)} = \%$$

where C is the length of a side of the perforations, $Z_1$ is the distance between the centre of a perforation on one row, and the centre of a perforation two rows below said perforation (i.e. the distance between aligned rows), and $Z_2$ is the distance between the centre of two perforations adjacent to one another on the same row. If the perforations are square and are aligned such that the perforations in an upper row are in the same position as the perforations in the row below, then the percentage of openness can be determined by the equation:

$$\frac{C^2 \times 100}{U_1 \times U_2} = \%$$

where C is the length of a side of the perforations, $U_1$ is the distance between the centre of a perforation on one row and the centre of the perforation directly below said perforation, and $U_2$ is the distance between the centre of a perforation and the centre of the perforation adjacent to said perforation on the same row.

The perforations 10 are to be positioned at places on the carrier intended to receive covering elements 3. As will be appreciated by the skilled person, perforations 10 can be provided in a regular or semi-regular arrangement over any suitable part of carrier 2, including over substantially all of the surface of the carrier 2. The carrier 2 may include regions or sections which are free of perforations 10. While in the preferred embodiments the apertures are circular, the apertures may be of any suitable shape such as square and may be in any appropriate arrangement including a rectangular arrangement.

Figure 11:
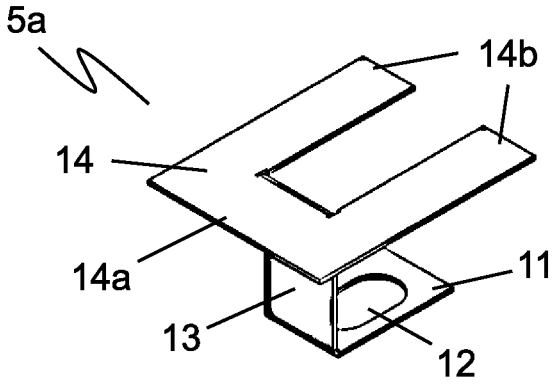
FIG. 11 is a perspective view of a bracket according to an aspect of the invention.
Figure 12:
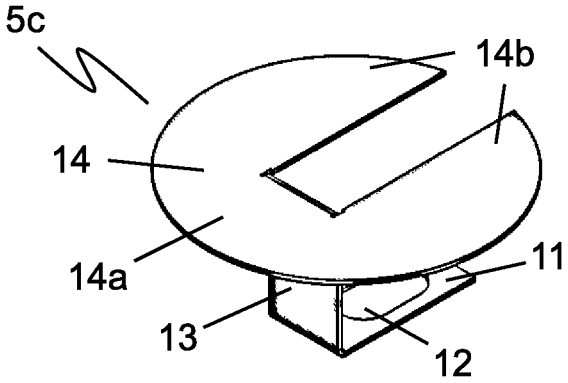
FIG. 12 is a perspective view of an alternative bracket according to an aspect of the invention.
Figure 13:
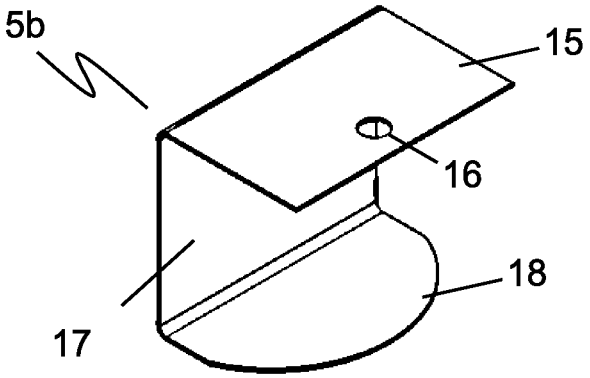
FIG. 13 is a perspective view of an end clip for attaching one end of a peripheral covering element to the carrier.

Covering elements 3 are attached to the carrier 2 via attachment members, particularly brackets 5*a*, shown in detail in FIG. 11, and end clips 5*b*, shown in detail in FIG. 13. FIG. 12 shows an alternative bracket 5*c* that may be used instead of the brackets shown in FIG. 10. All of the attachment members shown in FIGS. 1, 2 and 11-13 are made from 1 mm-thick stainless steel sheet material but variations in the thickness and/or type of material used are also within the scope of the invention. The regular arrangement of perforations 10 in the carrier 2 provide predetermined positions for the brackets 5*a* to be attached to the carrier using fixing members such as screws or bolts. Depending on the number and arrangement of covering elements on the carrier 2, each bracket 5*a* is used to attach one end of each covering element 3 to the carrier.

As shown in FIG. 11, each bracket 5*a* comprises a base 11. In this embodiment, the base 11 is a planar base. The bracket further comprises a slot 12 to allow a fixing member such as a stainless steel screw to pass therethrough and fix the bracket 5*a* to the carrier 2. The slot 12 is an elongate slot and this provides further maneuverability of the bracket 5*a*. Each bracket 5*a* also comprises an engagement surface 14. The engagement surface 14 is generally U-shaped and planar. The engagement surface 14 of each bracket 5*a* has a free end 14*a* for engaging a slot in a first covering element 3, and two prongs 14*b* for engaging a slot in a neighbouring covering element 3. While two prongs is preferable, a single prong in some embodiments would suffice. Each respective free end 14*a* is integrally connected to each prong 14*b*. Each bracket 5*a* further comprises a pillar 13 which connects the base 11 to the planar engagement surface 14. As shown in FIG. 11, the pillars 13 are planar and have a length of 10-15 mm. This length corresponds to the distance between the interior face and the slot of the covering element 3 for which the bracket 5*a* is to be used to retain, and brackets having different length pillars may be formed to cooperate with different sized or shaped covering elements.

Figure 14:
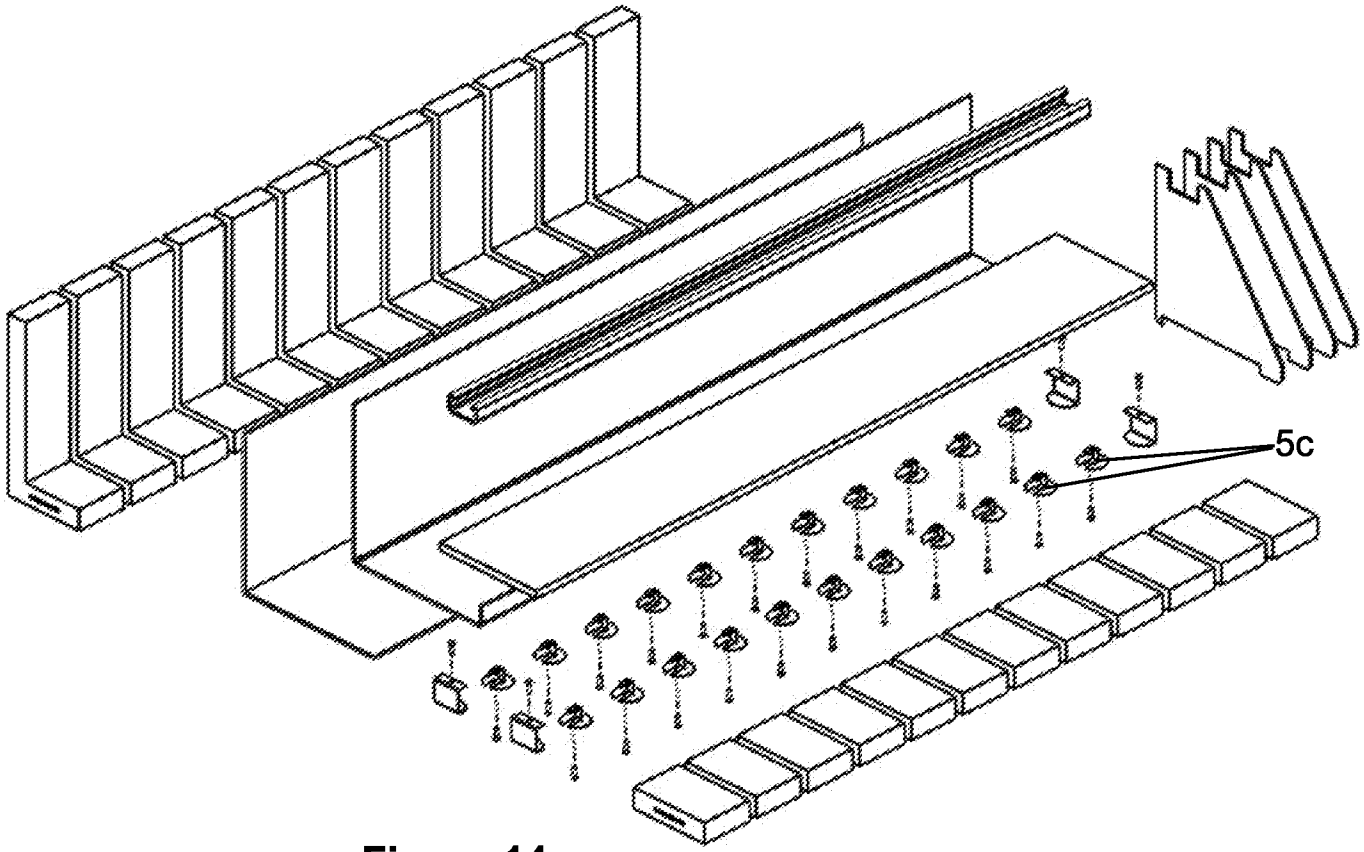
FIG. 14 is a rear exploded view of a similar support arrangement to that of FIG. 1, but wherein the alternative covering element support bracket of FIG. 12 is used instead of the bracket as shown in FIG. 11.
Figure 15:
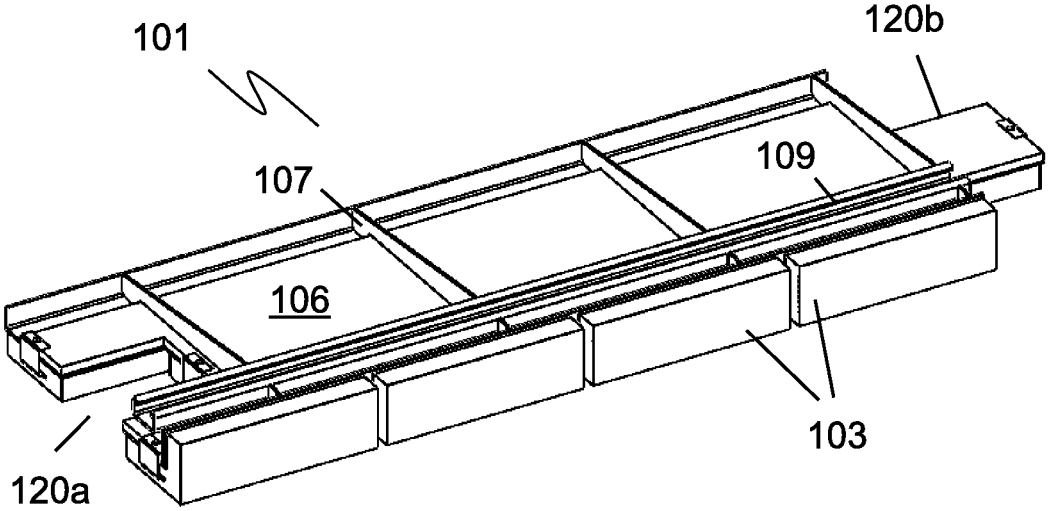
FIG. 15 is a front perspective view of an alternative embodiment of a covering element support arrangement according to the invention.
Figure 16:
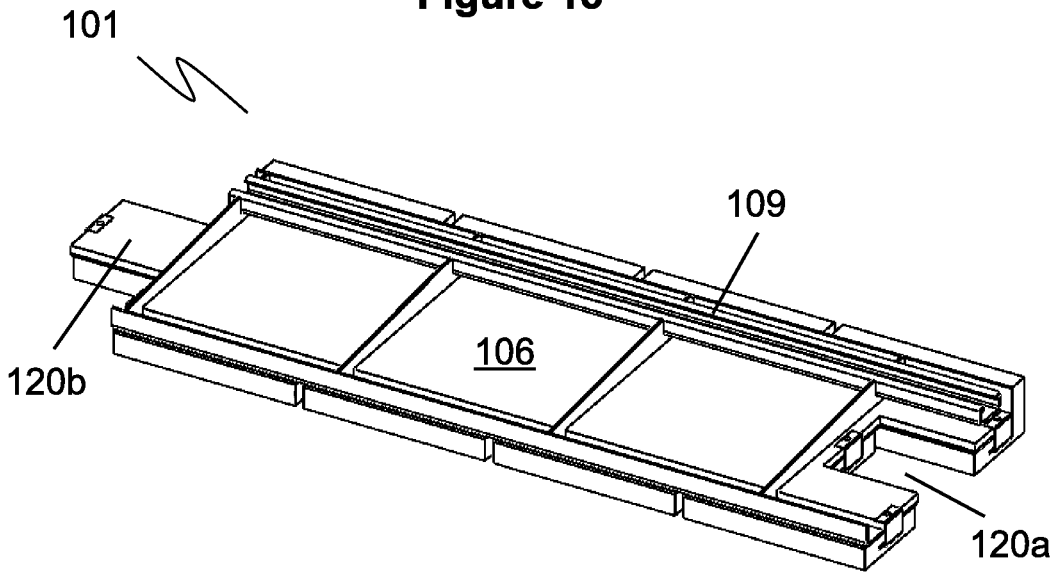
FIG. 16 is a rear perspective view of the covering element support arrangement of FIG. 15.
Figure 17:
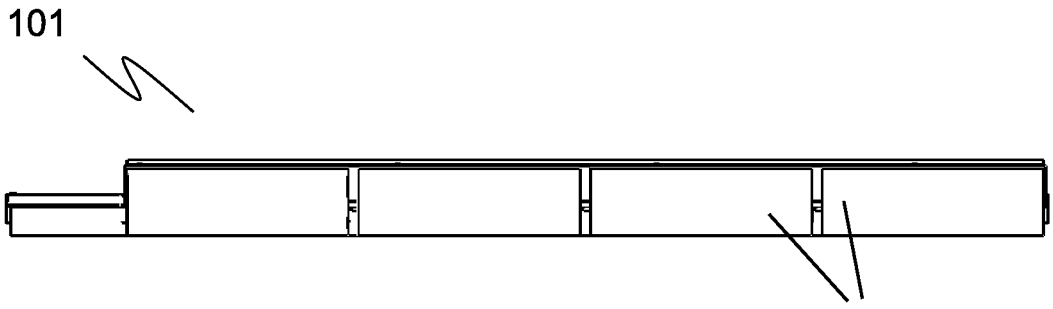
FIG. 17 is a front view of the covering element support arrangement of FIG. 15.
Figure 18:
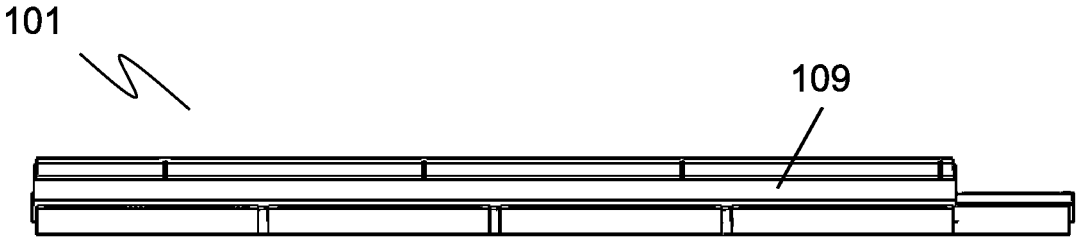
FIG. 18 is a rear view of the covering element support arrangement of FIG. 15.
Figure 19:
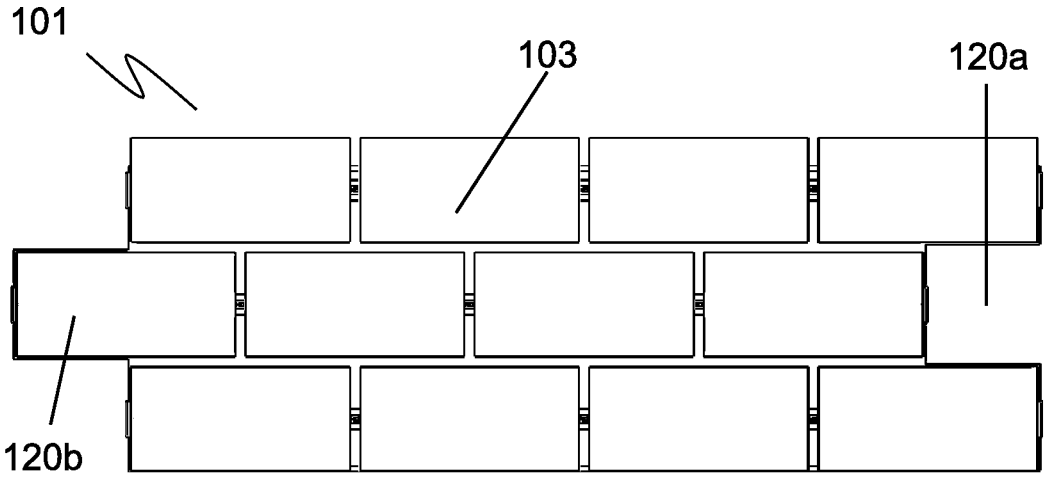
FIG. 19 is an underside/soffit view of the covering element support arrangement of FIG. 15.
Figure 20:
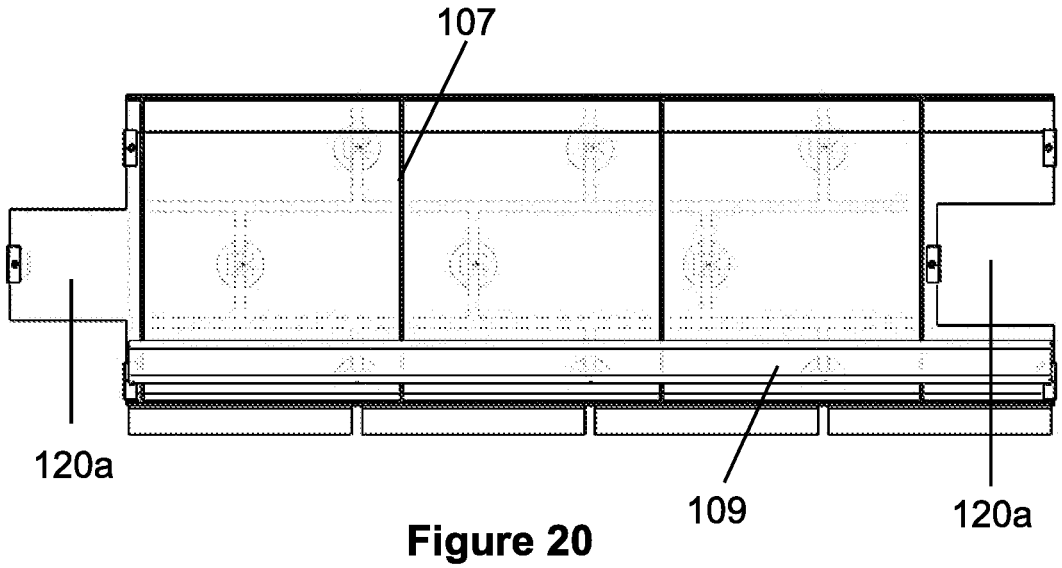
FIG. 20 is a top view of the covering element support arrangement of FIG. 15.
Figure 21:
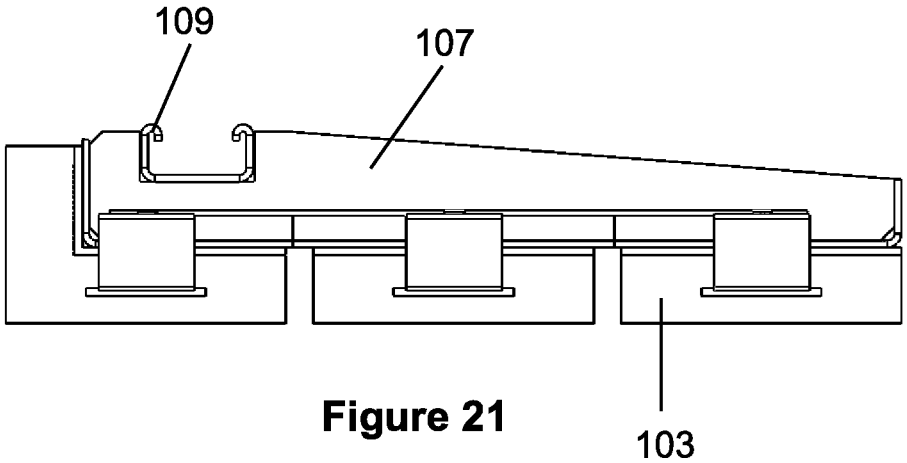
FIG. 21 is a side view of the covering element support arrangement of FIG. 15.
Figure 22:
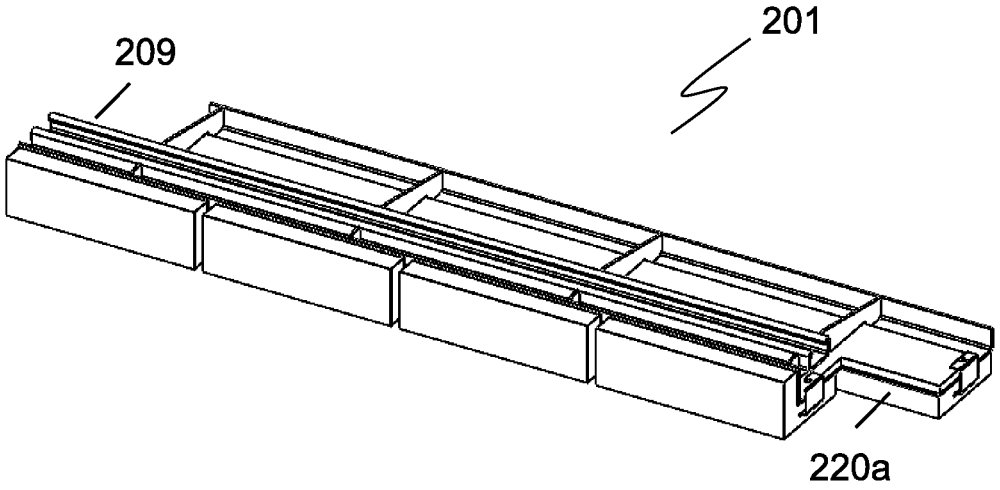
FIG. 22 is a front perspective view of a covering element support arrangement in accordance with a further embodiment of the invention.
Figure 23:
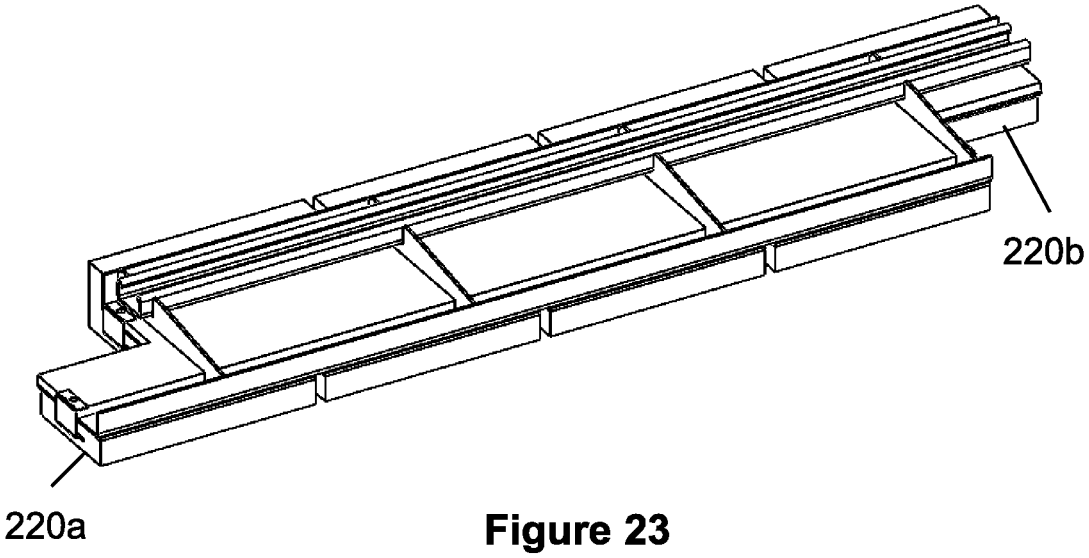
FIG. 23 is a rear perspective view of the covering element support arrangement of FIG. 22.
Figure 24:
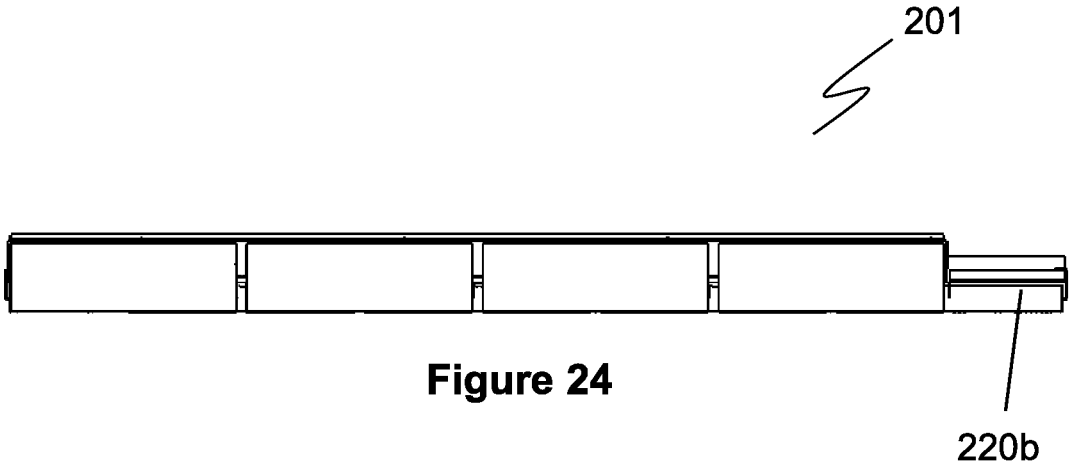
FIG. 24 is a front view of the covering element support arrangement of FIG. 22.
Figure 25:
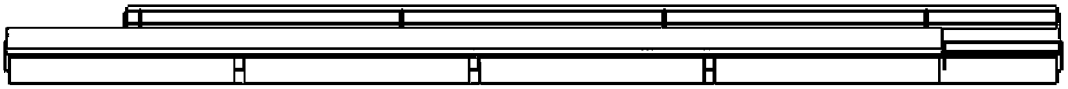
FIG. 25 is a rear view of the covering element support arrangement of FIG. 22.
Figure 26:
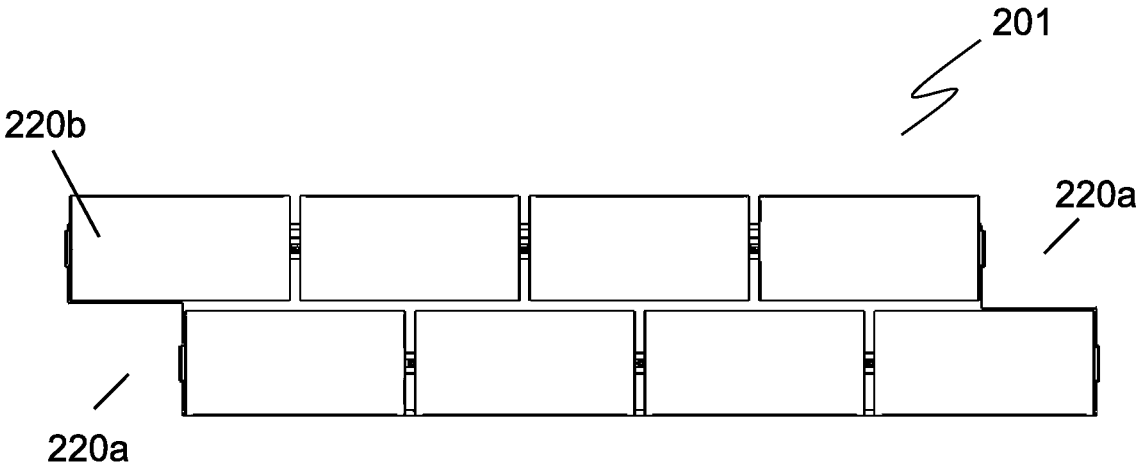
FIG. 26 is an underside/soffit view of the covering element support arrangement of FIG. 22.
Figure 27:
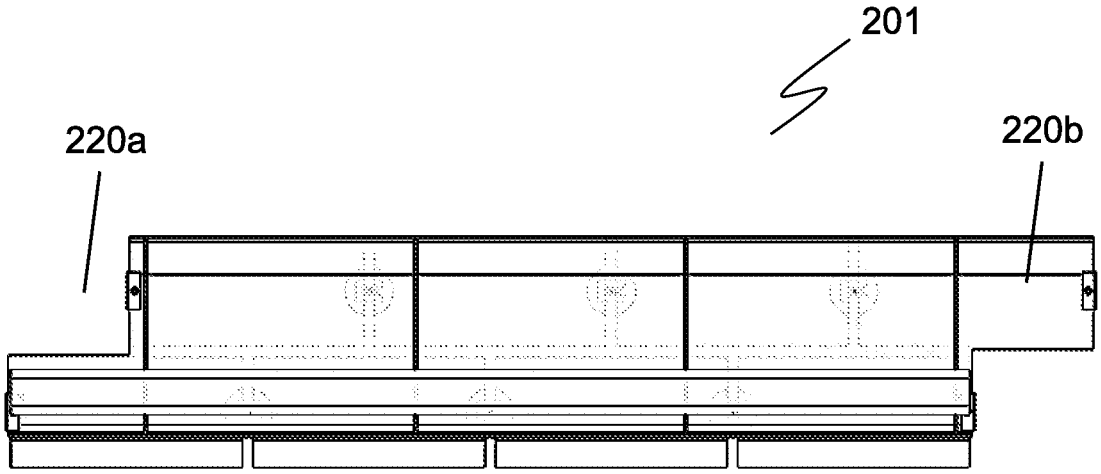
FIG. 27 is a top view of the covering element support arrangement of FIG. 22.
Figure 28:
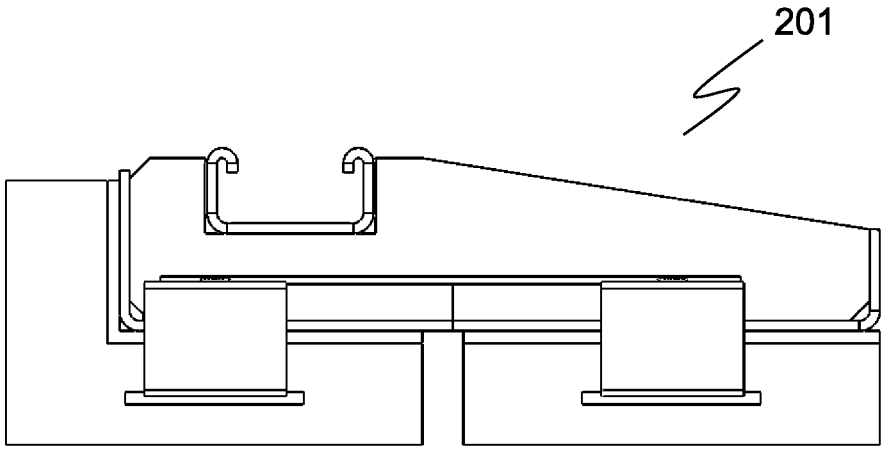
FIG. 28 is a side view of the covering element support arrangement of FIG. 22.

The outline of each bracket 5*a* is cut from a metal sheet and the cut shape is bent at either end of the pillar 13 to assume the form shown in FIG. 11 (see also FIG. 12). A first perpendicular bend defines the joint between the base 11 and the pillar 13 and a second perpendicular bend defines the joint between the pillar 13 and the planar engagement surface 14. In this way the base 11, planar engagement surface 14 and pillar 13 are integrally formed. The base 11 is located between the two prongs 14*b* at the opposite end of the pillar 13 to the planar engagement surface 14. The planar engagement means 14 and base 11 are substantially parallel. The base 11 and each prong 14*b* extends from the pillar 13 in a first direction perpendicular to the axis of the pillar 13 and the free end 14*a* extends from the pillar in a second direction (also perpendicular to the axis of the pillar 13) that is opposite the first direction. Bracket 5*c* as shown in FIG. 12 differs from that of bracket 5*a* in FIG. 11 in that the engagement surface 14 is circular in shape instead of rectangular. This can improve the strength of the fix of the covering element 3 to the carrier 2 as a greater amount of the bracket 5*c* is located within the slot of the covering element 3 after the bracket 5*c* is fixed to the carrier 2 (when compared with that of bracket 5*a*). FIG. 14 shows the same arrangement of that of FIGS. 1 and 2 however bracket 5*a* has been replaced with bracket 5*c*.

As shown in e.g. FIGS. 3 and 4, end clips 5*b* are used to attach covering elements 3 having an edge at the periphery of the covering element support arrangement 1 (referred to as 'peripheral covering elements'). The end clips 5*b*, shown in detail in FIG. 13, are generally C-shaped having a planar base 15 with a hole 16 for allowing a fixing means such as a screw or bolt to pass therethrough. End clip 5*b* also comprises a planar engagement surface 18 which is attached to the base 15 via a planar connection strip 17. Engagement surface 18 includes a curved free end for engaging a slot in a peripheral covering element 3. In this embodiment, the length of each connection strip 17 between the base 15 and the planar engagement surface 18 is 21-26 mm, which corresponds to the sum of distance between the interior face and the slot of the covering element 3, the thickness of the backing board 6, the thickness of the adhesive 4, and the thickness of the carrier 2.

Each end clip 5*b* is cut from a flat stainless-steel sheet and bent at either end of the connection strip 17 to assume the form shown in FIG. 13. A first perpendicular bend defines the joint between the base 15 and the connection strip 17 and a second perpendicular bend defines the joint between the connection strip 17 and the engagement surface 18. In this way the base 15, engagement surface 18 and connection strip 17 are integrally formed from a single sheet. The engagement surface 18 and base 15 are substantially parallel and extend from the connection strip 17 in substantially the same direction.

Figure 9:
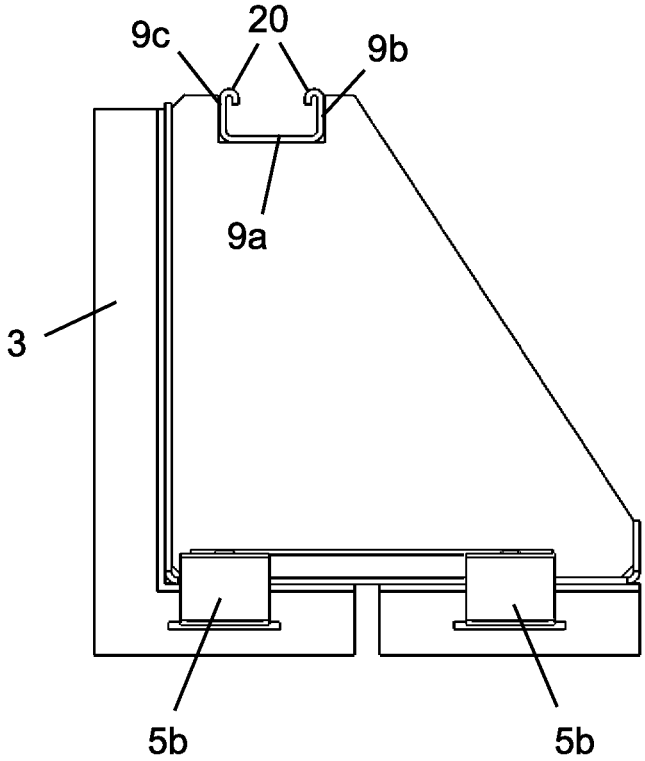
FIG. 9 is a side view of the covering element support arrangement of FIG. 1.

Returning to FIGS. 1-9, the covering element support arrangement 1 comprises a connection member 9 for connecting the covering element support arrangement 1 to a building or building component. The connection member 9 is operable to retain the covering element support arrangement 1 at or about a face of a building such that at least part of the covering element support arrangement 1 forms at least a part of a building soffit. The connection member 9 is elongate and comprises a 41 mm by 21 mm steel channel that extends between, and is attached to, gussets 7. The longitudinal axis of the connection member 9 is perpendicular to the plane of each gusset 7. As shown in FIG. 9, the connection member 9 has a base 9*a* with two mutually opposing sidewalls 9*b*, 9*c* that extend perpendicularly from the base 9*a*, and an opening that is mutually opposing the base 9*a*. The opening has two mutually opposed retaining lips 20 that extend from the upper portion of the sidewalls 9*b*, 9*c* to project over the opening. The connection member 9 is sized to receive a retaining member such as a spring nut or machined block, the position of the retaining member being adjustable along the length of the connection member 9.

In FIGS. 15-21 there is shown a second embodiment of a covering element support arrangement according to the invention illustrated generally by reference numeral 101. The differences between this second embodiment 101 and the first embodiment 1 lies in the size of the covering element support arrangement 101 (and therefore the sizes of e.g. covering elements 103 and gussets 107) and also the presence of an interlocking arrangement 120*a*, 120*b* (which lead to an alternative shape of the backing member 106). When a plurality of support arrangements 101 are to be connected to a building via their respective connection means 109, the interlocking arrangement allows proper and accurate alignment between neighbouring units by providing a female interlocking formation 120*a* and a male interlocking formation 120*b*. In the installed condition, the male interlocking formation 120*b* and female interlocking formation 120*a* are abutted to form an interlocked connection between the neighbouring units. In FIGS. 22-28 there is shown a third embodiment of a covering element support arrangement according to the invention illustrated generally by reference numeral 201 having an alternative interlocking arrangement 220*a*, 220*b* made up of a female interlocking arrangement 220*a* and a male interlocking arrangement 220*b* which abut when neighbouring units are in the installed position.

Figure 29:
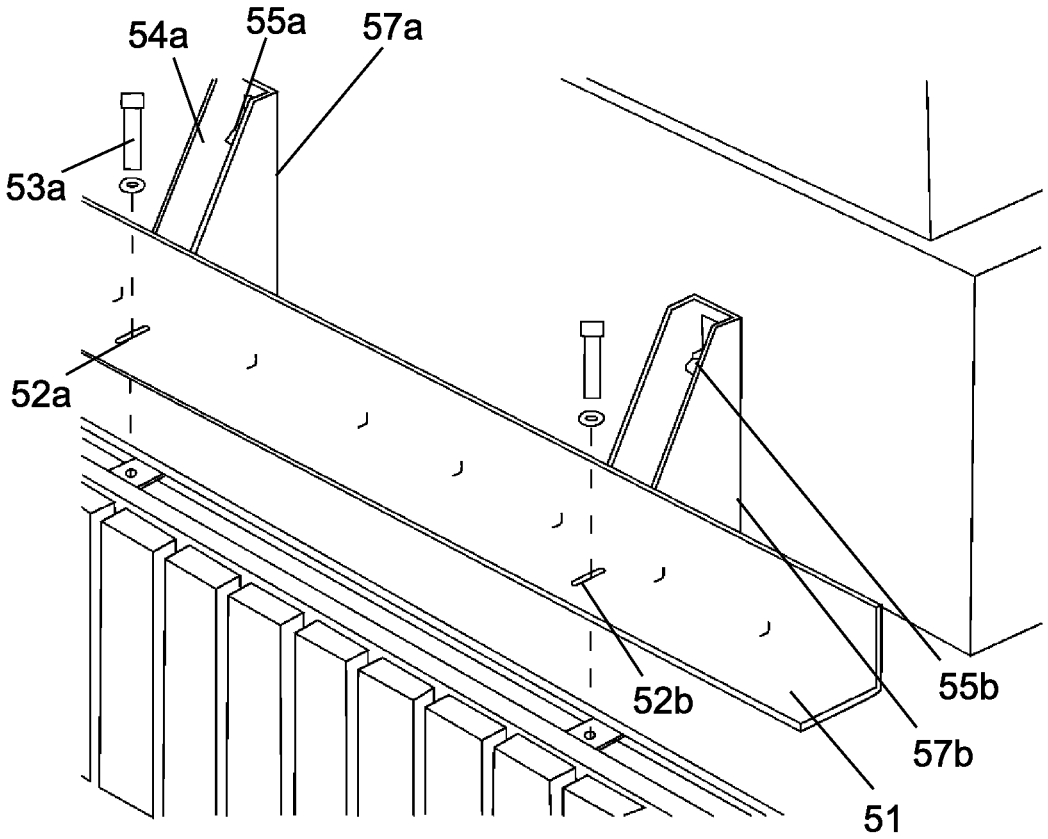
FIG. 29 is a front perspective view of a mount for a support arrangement as according to the invention.
Figure 30:
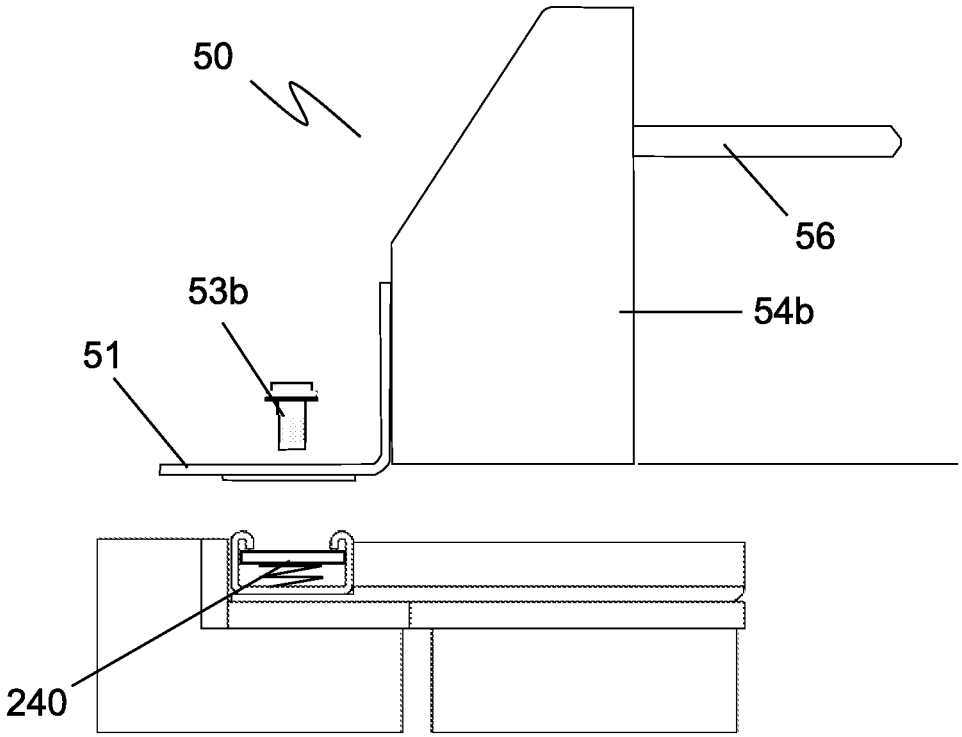
FIG. 30 shows a side view of the mount shown in FIG. 29, and a side view of an example embodiment of the covering element support arrangement 1.

As shown in FIGS. 29 and 30, connection member 9, 109, 209 is to be connected to a mount 50 which is in turn mechanically fixed to a building or building component (a lintel in the embodiment of FIG. 29). The mount 50 has a support surface 51 for masonry such as rows of brickwork. The support surface 51 functions as a shelf to which a covering element support arrangement 1, 101, 201 can be attached, but it also provides a platform for upper courses of brickwork. The support surface 51 has a thickness not greater than that of the space between rows of brickwork, such that the end portions of the support surface 51 can be embedded between rows of bricks. The support surface 51 has two elongate slots 52*a*, 52*b* extending therethrough. The slots 52*a*, 52*b* are sized to receive bolts 53*a*, 53*b* that can engage with the covering element support arrangement 1, 101, 201. In particular, the bolts 53*a*, 53*b* can engage with spring nut 240. The position of the covering element support arrangement 1 can be moved forwards or backwards by adjusting the location of the bolt 53*a*, 53*b* in the slot 52*a*, 52*b* and the covering element support arrangement 1, 101, 201 can be moved laterally by adjusting the location of the spring nut 240 in the channel of connection member 9, 109, 209.

The mount 50 further has two spaced apart mounting brackets 54*a*, 54*b* that each support the masonry support surface 51. The mounting brackets 54*a*, 54*b* have a slot (not shown) and a lock washer 55*a*, 55*b* arranged to attach the mounting brackets 54*a*, 54*b* to a wall with bolts 56. The bolts 56 extend through the slot and are fixed relative to the slot by the lock washers 55*a*, 55*b*. Each lock washer 55*a*, 55*b* has a body (not shown) and a protrusion (not shown) disposed on one face of the body. The protrusion is configured to be disposable in a corresponding slot of a mounting bracket 54*a*, 54*b*. The lock washer further has an engagement arrangement (not shown) disposed on the protrusion that is configured to be engageable with the slot of the bracket 54*a*, 54*b* and hold the body stationary with respect to the mounting bracket 54*a*, 54*b*. Further, there is a slotted hole (not shown) disposed in the body configured to admit a shaft of a bolt 56 therethrough to allow lateral movement of the body relative to the shaft while the shaft is admitted through the slotted hole. The mount 50 further has a shim 57*a*, 57*b* located and the wall, providing adjustability of the building arrangement.

The covering element support arrangement 1, 101, 201 is mounted to a wall by first attaching a mount 50 to the surface of the wall. The mounting brackets 54*a*, 54*b* of the mount 50 are first attached to the surface of the wall using a single bolt 56 for each mounting bracket 54*a*, 54*b*. A lock washer 55*a*, 55*b* is also used. The bolt 56 passes through the lock washer 55*a*, 55*b* and a slot of the mounting bracket 54*a*, 54*b* and into the wall. The lock washer 55*a*, 55*b* can fixedly adjust the location of the mounting bracket 54*a*, 54*b* relative to the placement of the bolt 56 after the bolt has been inserted into the wall. This enables the final location of the covering element support arrangement 1, 101, 201 on the building to be adjusted even after the bolt has been inserted into the wall. Once the mounting brackets 54*a*, 54*b* are fixed to the wall, the covering element support arrangement 1, 101, 201 can then be fixed to the masonry support surface 50. Initially, spring nuts 240 are inserted into the connection member 9, 109, 209 and moved along the channel to the location of the slots 52*a*, 52*b* in the masonry support surface 50. Then bolts 53*a*, 53*b* are inserted through the slots 52*a*, 52*b* and the covering element support arrangement 1, 101, 201 is raised, with the connection member 9, 109, 209 being located at the bolts 53*a*, 53*b*. The bolts 53*a*, 53*b* are tightened through the spring nuts 240 to fix the covering element support arrangement 1, 101, 201 to the mount 50.

A method of constructing a support arrangement 1 for covering elements 3 in accordance with an embodiment of the invention will now be explained. While the method will be explained with respect to the first embodiment of the invention, the method can be similarly applied to all embodiments of the invention. The method comprises providing a carrier 2 for receiving at least one covering element 3 and adapting the carrier 2 to allow covering elements 3 to be received by the carrier means 2 in a plurality of positions and configurations. Allowing the covering elements to be received on the carrier means in a plurality of positions provides a more adaptable covering element support arrangement 1 which can receive covering elements of different sizes.

Covering elements 3 in the form of masonry or brick slips are cut to the required size and a groove or slot is formed in two of the peripheral edges of each covering element 3. Each groove is located 10-15 mm from an interior face of the covering element.

The carrier 2 is cut to an appropriate size for forming at least part of a soffit of a building and receiving the required number of covering elements 3 to cover the soffit or part thereof. The carrier means is bent to be generally L-shaped with a soffit surface 2*b* which is perpendicular to an upstanding planar surface 2*a*. A further bend in the carrier 2 provides reinforcing flange 2*c* which is perpendicular to the soffit surface 2*b* and improves the rigidity of the carrier 2. A plurality of perforations 10 are formed in the carrier 2 by drilling or punching holes in the carrier 2 at regular intervals in a hexagonal arrangement. The carrier 2 is reinforced by welding a plurality of gussets 7 along the length of the carrier 2. Slots 8*a* are formed in the gussets 7 to accommodate a backing board and the gussets 7 are welded to the carrier 2 on either side of the slots 8*a*. A connection member 9 in the form of a steel channel is attached to slots 8*b* in each of the gussets 7 via welding. A backing member 6 is inserted between the carrier 2 and the slots 8*a* in the gussets 7.

A 3 mm-thick layer of adhesive is applied to the carrier at the position where a covering element 3 is to be attached and where there are perforations 10 in the carrier. A 1 mm-thick layer of adhesive is applied to a covering element and the covering element 3 is pressed onto the carrier 2. When the covering element 3 is pressed onto the carrier 2 after adhesive has been applied, some adhesive is pushed through the perforations 10 in the carrier 2. Pushing adhesive through a perforation causes the formation of a dome of adhesive on the side of the carrier 2 opposite the covering element 3. When the adhesive 4 subsequently hardens or sets, the dome forms an anchor for the adhesive 4 to be mechanically as well as adhesively bonded to the carrier 2.

While the adhesive 4 is still uncured, a bracket 5*a* is placed on the carrier 2 adjacent to the covering element 3 such that the base 11 of the bracket is in contact with the adhesive on the carrier 2. The bracket 5*a* is placed at an edge of the covering element 3 such that at least part of the engagement surface 14 is partially embedded in a slot in the peripheral edge of the covering element 3. In the preferred embodiments either the free end 14*a* or prongs 14*b* are partially embedded in the slot. A screw is then passed through the slot 12 in the bracket 5*a* and partially inserted into a perforation 10 in the carrier 2. Since the carrier 2 includes a high density of perforations 10 it is easy to find a perforation at a suitable position to attach the bracket. Lateral movement afforded by the slot 12 also facilitates fine adjustment of the position of the bracket 5*a* while the adhesive has not set or cured.

The process is repeated by applying a layer of adhesive to a further covering element 3 and pressing the further covering element onto the carrier adjacent to the previously-applied covering element 3. When the free end 14*a* of the already-applied bracket 5*a* is embedded in the slot of the previously-applied covering element 3, the prongs 14*b* are available to be inserted into a slot in a peripheral edge of the further covering element 3. A further bracket 5*a* is placed at the free edge of the further covering element 3 such that at least part of the engagement surface 14 is partially embedded in the further slot. Further covering elements 3 and brackets 5*a* are applied to form courses of covering elements as required, the planar engagement surface 14 of each bracket 5*a* being engaged in slots of two neighbouring covering elements 3.

After the adhesive 4 has fully hardened, which takes up to 24 hours, the stainless steel locating pins are removed and stainless steel screws are inserted into perforations 10 in the carrier 2 through the slots 12 in the brackets 5*a* and are fully screwed into the carrier 2 to the extent that they are partially embedded in the backing member 6.

Where a covering element 3 is located at the peripheral edge of the covering element support arrangement 1, that peripheral covering element 3 is retained on its outer edge using an end clip 5*b*. Preferably the method comprises inserting the planar engagement means 18 of the end clip 5*b* is inserted into the slot in the exposed edge of a peripheral covering element 3. The base 15 of the end clip 5*b* is attached to the backing member 6 by a screw which extends through aperture 16. The end clip 5*b* is arranged such that the backing member 6 lies between the base of the end clip and the carrier 2 and the connection strip 17 is proximal to an edge face of the backing member 6.

The covering element support member 1 is attached to a building via the connection member 9 and a mount 50. A retaining member such as a spring nut 240 is inserted into the connection member 9 and slid along said elongate connection member 9 to a desired location, thereby altering the final position of the covering element support arrangement 1 relative to a mount 50. The spring biases the nut towards the opening in the channel and the retaining lips 11 retain the spring within the channel such that a bolt can easily engage with the nut. Alternatively, a machined block (not shown) having an aperture for receiving a nut could be used within the connection member 9. The location of the covering element support arrangement 1 relative to the building component to which it is fixable can be adjusted along the longitudinal axis of the connection member 9 before torquing the fixings.

In the preceding discussion of the invention, unless stated to the contrary, the disclosure of alternative values for the upper or lower limit of the permitted range of a parameter, coupled with an indication that one of the values is more highly preferred than the other, is to be construed as an implied statement that each intermediate value of the parameter, lying between the more preferred and the less preferred of the alternatives, is itself preferred to the less preferred value and also to each value lying between the less preferred value and the intermediate value.

The features disclosed in the foregoing description or the following drawings, expressed in their specific forms or in terms of a means for performing a disclosed function, or a method or a process of attaining the disclosed result, as appropriate, may separately, or in any combination of such features be utilised for realising the invention in diverse forms thereof.

What is claimed is:

1. A covering element support arrangement for attaching covering elements to a building or building component, the covering element support arrangement comprising a carrier means for receiving covering elements thereon, wherein the covering elements are brick slips, block slips, stone slips, composite slips, or glass-reinforced plastic slips, and wherein the covering elements include an interior face for attachment to the carrier means, an exterior face opposite the interior face and a plurality of peripheral edge faces connecting the interior face and the exterior face, the covering element support arrangement comprising attachment means for attaching the covering elements to the carrier means, wherein there is a slot in one or more of the peripheral edge faces of the covering elements for receiving at least a portion of the attachment means, the attachment means comprising mechanical fastening means that are fastened to the carrier means and that are engaged with the covering elements to fix the covering elements to the carrier means, the carrier means being formed at least partially from a perforated sheet, the mechanical fastening means being engaged with the perforations, and wherein the frequency of the perforations is such that the covering elements are attached to the carrier means without requiring the covering elements to be initially aligned relative to any single perforation.

2. The covering element support arrangement as claimed in claim 1, wherein the mechanical fastening means comprises a bracket for fixing two adjacent covering elements to the carrier means.

3. The covering element support arrangement as claimed in claim 2, wherein each perforation provides an attachment means receiving means, and wherein the bracket is configured such that it is manoeuvrable laterally between adjacent covering elements when located in the gap between covering elements and/or is rotatable about its axis when located between two adjacent covering elements such that it can be maneuvered to align with an attachment means receiving means on the carrier means to enable fixing thereto.

4. The covering element support arrangement as claimed in claim 2, wherein the frequency of perforations in combination with the manoeuvrability of the bracket, is such that regardless of the location of the placement of the covering element on the covering means, at least one perforation will be suitable for use in fixing the covering element to the covering means.

5. The covering element support arrangement as claimed in claim 2, wherein the bracket can be fixed to the carrier means and be in engagement with two adjacent covering elements in more than one axial orientation relative to the covering elements.

6. The covering element support arrangement as claimed in claim 2, wherein the bracket comprises a base that is fixable to the carrier means, wherein the base abuts the carrier means in use and wherein the base of the bracket comprises an aperture, hole or slot for allowing a fixing means to pass therethrough.

7. The covering element support arrangement as claimed in claim 6 wherein the base of the bracket comprises an elongate aperture.

8. The covering element support arrangement as claimed in claim 6, wherein the bracket comprises an engagement means for engaging with one or more covering elements, and wherein the engagement means is shaped such that it does not obscure the view of the base of the bracket in use.

9. The covering element support arrangement as claimed in claim 8, wherein the engagement means is a planar engagement means and wherein the engagement means is shaped to extend between a slot in a first covering element to a slot in an adjacent second covering element.

10. The covering element support arrangement as claimed in claim 9, wherein a portion of the bracket extends from the engagement means towards the carrier means in use, and wherein the bracket comprises a pillar for connecting the base to the engagement means.

11. The covering element support arrangement as claimed in claim 10, wherein the bracket comprises a single pillar for connecting the base to the engagement means.

12. The covering element support arrangement as claimed in claim 10, wherein the base is connected to the pillar at one end of the pillar, and the engagement means is connected to the pillar at an opposing end of the pillar.

13. The covering element support arrangement as claimed in claim 9, wherein the engagement means of the bracket comprises a free end for engaging a slot in a first covering element, and at least one prong for engaging a slot in a second covering element, the first covering element and second covering element being neighbouring covering elements, and wherein the free end is integrally connected to the or each prong.

14. The covering element support arrangement as claimed in claim 13, wherein the base extends from the pillar in a first direction and wherein the free end extends from the pillar in a second direction.

15. The covering element support arrangement as claimed in claim 14, wherein the or each prong extends from the free end in the first direction.

16. The covering element support arrangement as claimed in claim 1, wherein the attachment means comprises at least one end clip for attaching one end of a peripheral covering element to the covering element support arrangement.

17. The covering element support arrangement as claimed in claim 1, wherein the covering element support arrangement comprises a backing means located at the back of the carrier means, and wherein the backing means is formed at least partially from cementitious and/or composite material.

18. The covering element support arrangement as claimed in claim 1, wherein the covering element support arrangement comprises reinforcement means.

19. The covering element support arrangement as claimed in claim 1, wherein the covering element support arrangement comprises a connection means for connecting the covering element support arrangement to a building or building component.

20. The covering element support arrangement as claimed in claim 1, wherein the covering element support arrangement comprises interlocking means for interlocking with neighbouring covering element support element.

* * * * *